US005754155A

United States Patent [19]

Kubota et al.

[11] Patent Number: 5,754,155

[45] Date of Patent: May 19, 1998

[54] IMAGE DISPLAY DEVICE

[75] Inventors: Yasushi Kubota, Sakurai; Ichiro Shiraki, Tenri, both of Japan

[73] Assignee: Sharp Kabushiki Kaisha, Osaka, Japan

[21] Appl. No.: 591,281

[22] Filed: Jan. 25, 1996

[30] Foreign Application Priority Data

Jan. 31, 1995 [JP] Japan ..... 7-014441

[51] Int. Cl.[6] ..... G09G 3/36

[52] U.S. Cl. ..... 345/98; 345/100; 345/206; 345/211

[58] Field of Search ..... 345/87, 90, 92, 345/98, 100, 204, 205, 206, 211, 102; 349/33, 34

[56] References Cited

U.S. PATENT DOCUMENTS

| | | | |
|---|---|---|---|
| 3,836,862 | 9/1974 | Seely et al. . | |
| 4,755,768 | 7/1988 | Shimokawa . | |
| 5,087,890 | 2/1992 | Ishiguro et al. . | |
| 5,089,810 | 2/1992 | Shapiro et al. . | |
| 5,105,187 | 4/1992 | Plus et al. . | |
| 5,111,195 | 5/1992 | Fukuoka et al. . | |
| 5,196,738 | 3/1993 | Takahara et al. . | |
| 5,243,333 | 9/1993 | Shiba et al. | 345/211 |
| 5,252,957 | 10/1993 | Itakura . | |

FOREIGN PATENT DOCUMENTS

| | | |
|---|---|---|
| 1-38727 | 9/1989 | Japan . |
| 3-278021 | 12/1991 | Japan . |
| 4-142591 | 5/1992 | Japan . |
| 4-201581 | 7/1992 | Japan . |
| 5-5865 | 1/1993 | Japan . |
| 5-173504 | 7/1993 | Japan . |
| 7-162788 | 6/1995 | Japan . |

OTHER PUBLICATIONS

"A Thin-Film-Transistor-Controlled Liquid-Crystal Numeric Display", IEEE Trans., Electron Device, vol. ED-26, pp. 802-806, May 1979, pp. 109-113 by Erskine et al.

"Thin Film Active Devices", Handbook of Thin Film Technology, pp. 20-1 through 20-17 by Weimer.

*Primary Examiner*—Xiao Wu

*Attorney, Agent, or Firm*—Nixon & Vanderhye P.C.

[57] ABSTRACT

In an image display device, a reference voltage generating circuit of a power supply circuit, which applies power supply voltages $V_{GH}$ and $V_{GL}$ to a scan signal line driving circuit, is formed on a substrate where picture elements for display are formed, and a transistor which composes the reference voltage generating circuit has the approximately same threshold voltage as a picture element transistor $TR_{(PIX)}$ which composes the picture elements for display. As a result, the power supply voltages $V_{GH}$ and $V_{GL}$ to the scan signal line driving circuit automatically obtain which is optimized for a characteristic of the transistor TR(PIX) which composes the picture elements for display. Therefore, the power supply voltages $V_{GH}$ and $V_{GL}$ do not require adjustment per picture element array or every time when the usage environment is changed. As a result, the cost of adjustment is reduced and convenience of the usage is improved.

13 Claims, 26 Drawing Sheets

IMAGE DISPLAY DEVICE

FIELD OF THE INVENTION

The present invention relates to an image display device which adopts an active matrix driving method, especially relates to an image display device that automatically optimizes a supply voltage of its driving circuit.

BACKGROUND OF THE INVENTION

Various driving methods are adopted to an image display device according to application, and especially an active matrix driving method that is suitable for displaying graphics is known.

As shown in FIG. 20, such an image display device adopting the active matrix driving method is provided with a picture element array 101, a scan signal line driving circuit 102, a data signal line driving circuit 103 and a timing signal generating circuit 104. In the image display device having such an arrangement, the scan signal line driving circuit 102 outputs a scan signal to each scan signal line "GL", mentioned later, of the picture element array 101 by using a timing signal "TIM" that is generated based upon a synchronizing signal "SYNC" in the timing signal generating circuit 104. Moreover, the data signal line driving circuit 103 transmits (or amplifies and transmits) a sampled video signal "DATA" to each data signal line "SL", mentioned later, by using a timing signal "TIM".

As shown in FIG. 21(*a*), in the picture element array 101, a plurality of scan signal lines "GL" and a plurality of data signal lines "SL" intersect each other, and a picture element 105 is provided in a portion which is surrounded by the two adjacent scan signal lines "GL" and the two adjacent data signal lines "SL". In such a manner, the picture elements 105 are arranged in a matrix pattern in the picture element array 101. One data signal line "SL" is allocated to one row, and one scan signal line "GL" is allocated to one line.

In the case of a liquid crystal display device, as shown in FIG. 21(*b*), the picture element 105 is composed of a picture element transistor (ie. a transistor) $TR_{(PIX)}$, and a picture element capacity $C_p$ including a liquid crystal capacity $C_L$ and an auxiliary capacity $C_S$ which is added if necessary. In general, in an active matrix-type liquid crystal display device, the auxiliary capacity $C_S$ is added to the picture element 105 in parallel with the liquid crystal capacity $C_L$ in order to stabilize display. The auxiliary capacity minimizes a leakage current of the liquid crystal capacity $C_L$ and the transistor $TR_{(PIX)}$, fluctuations in a picture element potential due to a parasitic capacity between a gate and a source of the transistor $TR_{(PIX)}$, and influence upon a display data dependency of the liquid crystal capacity $C_L$, etc.

The gate of the transistor $TR_{(PIX)}$ is connected to the scan signal line GL. Moreover, each one electrode of the liquid crystal capacity $C_L$ and the auxiliary capacity $C_S$ is connected to the data signal line SL via a drain electrode and a source electrode of the transistor $TR_{(PIX)}$, and the other electrode of the liquid crystal capacity $C_L$ is connected to a counter electrode across a liquid crystal cell. The other electrode of the auxiliary capacity CS is connected to a common electrode, not shown, that is common to all the picture elements 105 (Cs on common construction) or to the scan signal line GL (Cs on gate construction) that is adjacent to the picture element 105.

In the latter case, since the parasitic capacity of the scan signal line GL increases, a delay of a signal is increased and distortion of a signal waveform is caused. Meanwhile, in the former case, the parasitic capacity of the scan signal line GL does not increase, but an auxiliary capacity line should be additionally provided in parallel with the scan signal line GL, so numerical aperture is lowered.

The scan signal lines GL are connected to the scan signal line driving circuit 102, and the data signal lines SL are connected to the data signal line driving circuit 103. Moreover, as shown in FIG. 20, the scan signal line driving circuit 102 and the data signal line driving circuit 103 are driven by supply voltages VGH and VGL and supply voltages VSH and VSL that are different from one another through supply circuits 106 and 107.

In the above image display device, the data signal line driving circuit 103 outputs a display data signal per one picture element or per 1 horizontal scanning period (1H line) to the data signal lines SL. Moreover, when the scan signal lines GL are in an active state, the transistors $TR_{(PIX)}$ are in conducting state. As a result, the display data signal to be transmitted to the data signal lines SL is written to the picture element capacity $C_P$. Then, display is maintained by charges written to the picture element capacity $C_P$.

At this time, in order to prevent deterioration of the liquid crystal capacity $C_L$ of the picture element 105, alternating current drive should be carried out. If the alternating current drive (inversion drive) is carried out with a period of a frame, a flicker is produced according to the frame frequency. In the case where the frame frequency is 60 Hz, for example, a flicker of 30 Hz is produced. For this reason, besides of the frame inversion, so called "frame+gate line inversion" drive that reverses polarity per one horizontal scanning period, or so-called "frame+source line inversion" drive which reverses polarity of a data signal per one row in a field and polarity per one vertical scanning period is usually carried out.

In addition, the data signal line driving circuit 103 adopts a point sequential driving method and a line sequential driving method.

In the point sequential driving method, a sampled video signal is directly written to the data signal lines SL. As shown in FIG. 22, the data signal line driving circuit 103 adopting the point sequential drive method has a shift register 111, latch circuits 112 and sampling switches 113. In the data signal line driving circuit 103, a start pulse "TIM" (timing signal) inputted to the shift register 111 is synchronized with a clock signal "CLK" so as to be shifted. Thereafter, the outputted pulse is transmitted through the latch circuit 112 to the sampling switch 113. When the sampling switch 113 is closed by the pulse, the video signal "DATA" is supplied to the data signal lines $SL_i$, $SL_{i+1}$. . . via the sampling switch 113.

In the data signal line driving circuit 103 adopting the point sequential driving method, since the video signal "DATA" is transmitted to the data signal lines $SL_i$, $SL_{i+1}$. . . via the sampling switches 113, the size of the driving circuit becomes small. However, this shortens a writing time, so enlargement of a screen is limited.

As shown in FIG. 23, it is desirable that the sampling switch 113 has a CMOS structure from the standpoints of the sampling ability and of decrease in the level fluctuations of the video signal. The sampling switch 113 is a transmission gate which is composed such that an n-channel transistor 113*a* and a p-channel transistor 113*b* are connected in parallel. The n-channel transistor 113*a* is driven by two inverters 114 and 115, and the p-channel transistor 113*b* is driven by one inverter 116. As a result, control signals (gate voltages) with opposite polarity to each other to the gate electrodes so that the n-channel transistor 113a and the p-channel transistor 113b are in conducting state simultaneously, and the transistors take the video signal "DATA" in.

Meanwhile, in the line sequential driving method, after a sampled video signal is temporarily transmitted to a data storage section, the video signal is amplified by an amplifier so as to be written to the data signal lines SL. As shown in FIG. 24, the data signal line driving circuit 103 adopting the line sequential driving method has a shift register 111, latch circuits 112, sampling switches 117 and 118, buffer amplifiers 119, sampling capacities $C_{samp}$ and hold capacities $C_{hold}$.

In such a data signal line driving circuit 103, after the inputted video signal is sampled by the sampling switches 117 during a certain horizontal scanning period, the video signal is temporarily stored in the sampling capacity $C_{samp}$. The stored sampling data (charges) are transmitted through the sampling switches 118, which are actuated by synchronizing with a data transmitting signal "TRF", to the hold capacity $C_{hold}$ so as to be maintained during a horizontal retrace line period. Then, a signal having the same level as of the voltage held by the hold capacity $C_{hold}$ is written to the data signal lines $SL_i$, $SL_{i+1}$, . . . via the buffer amplifiers 119.

The data signal line driving circuit 103 adopting the line sequential driving method collectively writes the temporarily sampled video signal by 1 line to the data signal line SL by means of the buffer amplifier 119. The size of the driving circuit becomes larger, but sufficient time is provided to the writing, so this circuit is adoptable to a large-scale screen.

A supply voltage of the above driving circuits (a driving voltage of the final-stage circuit in the case where a level shifter is provided to its inside) is determined as follows.

The supply voltage of the scan signal line driving circuit 102 (the output voltage to the scan signal line) is applied such that the transistor $TR_{(PIX)}$ can hold the video signal "DATA" on the low voltage side by only 1 frame period and that the picture element transistor can write the video signal "DATA" on the high-voltage side within prescribed period.

More specifically, a potential $V_{GL}$ on a low voltage side and a potential $V_{GH}$ on the high voltage side of the scan signal line driving circuit 102 become as follows when the central value of the video signal is reference:

$$V_{GL}=-V_{sat}+V_{th(PIX)}-V_{off(PIX)}$$

$$V_{GH}=V_{sat}+V_{th(PIX)}+V_{on(PIX)} \qquad \text{Equ. (1)}$$

where $V_{sat}$ is a saturation voltage of liquid crystal, $Vth_{(PIX)}$ is a threshold voltage of the transistor $TR_{(PIX)}$ and $V_{on(PIX)}$ and $V_{off(PIX)}$ are respectively an on-margin and off-margin of the picture element transistor. Here, the on-margin is a margin of the voltage to be applied to the gate electrode of the picture element transistor at the time of writing, and the off-margin is a margin of the voltage to be applied to the gate electrode of the picture element transistor at the time of holding.

The supply voltage of the data signal line driving circuit 103 adopting the point sequential driving method (a voltage which becomes a control signal of a CMOS sampling switch) is set individually on the low voltage side and on the high voltage side. In other words, the supply voltage of low level is applied such that an nMOS sampling transistor can hold the video signal by only 1 horizontal period and that a pMOS sampling transistor can write the video signal within prescribed period. Meanwhile, the supply voltage of high level is applied such that the pMOS sampling transistor can hold the video signal by only 1 horizontal period and that the nMOS sampling transistor can write the video signal within prescribed period.

Since the actual supply voltage is mostly limited by the holding characteristic, the following describes the case where the holding characteristic is considered. More specifically, a potential $V_{SL}$ on the low voltage side and a potential $V_{SH}$ on the high voltage side of the data signal line driving circuit become as follows when the central value of the video signal is reference:

$$V_{SL}=-V_{sat}+V_{th(n)}-V_{off(SD)}$$

$$V_{SH}=V_{sat}+V_{th(p)}+V_{off(SD)} \qquad \text{Equ. (2)}$$

where $V_{sat}$ is a saturation voltage of liquid crystal, $V_{th(n)}$ is a threshold voltage of the nMOS sampling transistor, $V_{th(p)}$ is a threshold voltage of the pMOS sampling transistor and $V_{off(SD)}$ is an off-margin of the sampling transistor. The off-margin is a margin of a voltage to be applied to the gate electrode of the sampling transistor at the time of holding.

Meanwhile, the buffer amplifier 119 adopting the line sequential driving method is arranged like a buffer amplifier 119a shown in FIG. 25 or a buffer amplifier 119b shown in FIG. 26, for example. A bias voltage of the buffer amplifier 119 is applied so that bias transistors (transistors $TR_{11e}$, $Tr_{11g}$, $TR_{12b}$ and $TR_{12c}$) operate as constant current source in a saturation state.

More specifically, a bias voltage $V_{b(n)}$ of the nMOS buffer amplifier and a bias voltage $V_{b(p)}$ of the pMOS buffer amplifier become as follows:

$$V_{b(n)}=V_{L(amp)}+V_{th(n)}+V_{on(amp)}$$

$$V_{b(p)}=V_{H(amp)}+V_{th(p)}-V_{on(amp)} \qquad \text{Equ. (3)}$$

where $V_{L(amp)}$ is a potential on the low voltage side of the driving voltage of the buffer amplifier 119, $V_{H(amp)}$ is a potential on the high voltage side, $V_{th(n)}$ is a threshold voltage of the nMOS bias transistor, $V_{th(p)}$ is a threshold voltage of the pMOS bias transistor and $V_{on(amp)}$ is an on-margin of the bias transistor. The on-margin is a margin of a voltage, which is applied to the gate electrode of the bias transistor so that the bias transistor operates as a constant current source.

The above equations can be applied to both the buffer amplifiers of FIGS. 25 and 26. $V_{b11a}$ and $V_{b11b}$ of FIG. 25 and $V_{b12a}$ of FIG. 26 are $V_{b(n)}$, and $V_{b12b}$ of FIG. 26 is $V_{b(p)}$.

In most of the previous active matrix-type liquid crystal display devices, the picture elements 105 were composed of an amorphous silicon thin film transistor formed on a glass substrate. Moreover, a scan signal line driving circuit 102 and a data signal line driving circuit 103 were a plurality of driver ICs that is externally mounted to the glass substrate.

On the contrary, in order to realize small-sizing of an image display device, improvement in its reliability, lowering of its cost, etc., a technique, where a scan signal line driving circuit 102 and a data signal line driving circuit 103 are monolithically arranged on a substrate on which a picture element array 101 is formed, has been developed in recent years.

In this case, a field effect transistor composed of monocrystal, polycrystal, or amorphous silicon thin film is used as an active device. Actually, a polycrystal silicon thin film transistor is usually used because it can be formed so as to have a larger area.

As to the polycrystal silicon thin film transistors, the sizes of crystal grains and the states of interfaces are different due to respective manufacturing conditions. As a result, the transistor characteristics (mobility of carrier, a threshold voltage, leak current, etc.) sometimes change greatly. For example, the variation in the threshold voltage falls within several dozens mV on one substrate. On the contrary, it is not uncommon that the variation in the threshold voltage is several V on different substrates.

In addition, a change in the transistor characteristics due to a change in surrounding temperature should be considered. Especially in the case where a liquid crystal display device is used as a light shutter for a projector, the surrounding temperature occasionally becomes not less than 60° C., so this could be a cause of the great change in the transistor characteristics. In the case where the transistor characteristics change in the above manner, the following problems possibly arise.

In other words, the driving voltage and the bias voltage in the scan signal line driving circuit 102 and the data signal line driving circuit 103 of the liquid crystal display device are determined according to the equations (1) through (3), but they depend on the threshold voltage of the transistor. As mentioned above, when the threshold voltage varies between the panels (substrates) or is greatly changed due to the surrounding temperature, the driving voltage and the bias voltage should be changed accordingly.

This raises manufacturing cost of the image display device, and deteriorates convenience of usage of the image display device.

Japanese Unexamined Patent Publication No. 3-278021/1991 (Tokukaihei 3-278021) discloses a method for compensating change in output characteristics (output level) of a driving circuit due to a temperature drift and aging of picture elements, variations in characteristics of picture elements, etc. by feeding back an image signal during a blanking period to the output level. However, this method compensates the level of the image signal, and does not compensate the level of the power supply, so this does not essentially solve the above problems.

SUMMARY OF THE INVENTION

It is an object of the present invention to provide a low-priced and convenient image display device which does not require manual adjustment of a driving voltage and a bias voltage.

In order to achieve the above object, an image display device of the present invention has (1) a first transistor which is provided to picture elements or a signal supplying circuit which supplies a signal to the picture elements, (2) a second transistor which is formed on a substrate where the first transistor is formed, and (3) a power supply circuit having a reference voltage generating circuit which generates a reference voltage based upon a threshold voltage of the second transistor and a current supplying circuit which supplies a current to the signal supplying circuit based upon the output of the reference voltage supplying circuit.

In accordance with the above arrangement, the power supply circuit applies a voltage, which is optimized for a characteristic of the first transistor, to the signal supplying circuit based upon the threshold voltage of the second transistor having the approximately same characteristic as the first transistor. Moreover, the voltage applied by the power supply circuit follows a change in the threshold voltage of the first transistor due to the usage environment.

Therefore, even if the threshold voltage of the first transistor is different between each substrate, or if the threshold voltage is changed due to a change in the usage environment, the voltage applied by the power supply circuit does not require adjustment. As a result, the cost of adjustment is reduced and convenience of the usage is improved. Moreover, since the most suitable voltage to be supplied to the signal supplying circuit is always maintained, the image display device can display an image with high quality. Therefore, the image display device with excellent ability can be provided at lower price.

Various kinds of combinations of the signal supplying circuit and the first transistor are considered. For example, the first transistor may be a picture element transistor, and the signal supplying circuit may be a circuit, such as the scan signal line driving circuit, which supplies a control signal. In this case, the second transistor as well as the picture element transistor is formed on one substrate, and the second transistor and the picture element transistor have the approximately same threshold voltage. As a result, the power supply circuit applies a driving voltage, which is optimized for the characteristic of the picture element transistor, to the signal supplying circuit. Moreover, the signal supplying circuit may be a circuit for applying a video signal, such as the data signal line driving circuit including the first transistor, or may be a buffer amplifier including the first transistor. The buffer amplifier is provided to the output stage of the data signal line driving circuit, for example. As a result, the driving voltage or the bias voltage of the signal supplying circuit obtains an automatically-optimized value. In any arrangements, since the power supply circuit applies the automatically-optimized voltage to the signal supplying circuit, the image display device with high ability can be provided at lower price.

In addition, it is preferable that the first and second transistors are formed so as to have the approximately same element arrangement. As a result, the characteristics of the first and second transistors can be easily and accurately arranged.

In addition, it is preferable that the first and second transistors are made of a thin film transistor, such as a monocrystal silicon thin film, a polycrystal silicon thin film or an amorphous silicon thin film. Such a thin film transistor is inferior to a transistor having the conventional arrangement formed on a monocrystal silicon substrate in controllability (variations). Therefore, adjustment of the supply voltages becomes more important. However, in the image display device of the present invention, since the adjustment of the supply voltage is not required, the thin film transistor can be put efficiently to practical use, thereby making it possible to realize a large-sized image display device whose packaging is easy. In addition, it is preferable that the first and second transistors are formed by a polycrystal silicon thin film formed at temperature of 300° C. to 600° C. As a result, a glass substrate can be used as the thin film substrate. Therefore, it is possible to realize a larger image display device whose packaging is easier.

In addition, the current supplying circuit may be formed on the substrate where the first and second transistors were formed, or may be formed on different substrates. For example, in the case where they are formed on the same substrate, wirings between them (signal lines and power lines) are formed inside the substrate. Therefore, the packaging of the image display device is simplified. Meanwhile, in the case where they are formed on different substrates, an usual integrated circuit (IC) formed on a monocrystal silicon substrate can be used as the current supplying circuit. As a result, the ability to supply a current in the current supplying circuit becomes large, and thus the stable power supply circuit is arranged.

In addition, the picture element may be provided with liquid crystal elements. In a liquid crystal display device, as a number of gradations of display increases, requirements of the writing and retaining of a video signal become more strict, and thus the supply voltage should be adjusted more exactly. However, in accordance with the above arrangement, since the supply voltage should not be adjusted, the liquid crystal display device can easily meet these requirements. As a result, a liquid crystal display device whose convenience of usage is excellent can be obtained at low price.

For fuller understanding of the nature and advantages of the invention, reference should be made to the ensuing detailed description taken in conjunction with the accompanying drawings.

DETAILED DESCRIPTION OF THE PREFERRED EMBODIMENTS

[EMBODIMENT 1]

The following describes the first embodiment of the present invention in reference to FIGS. 1 through 7.

Figure 1:
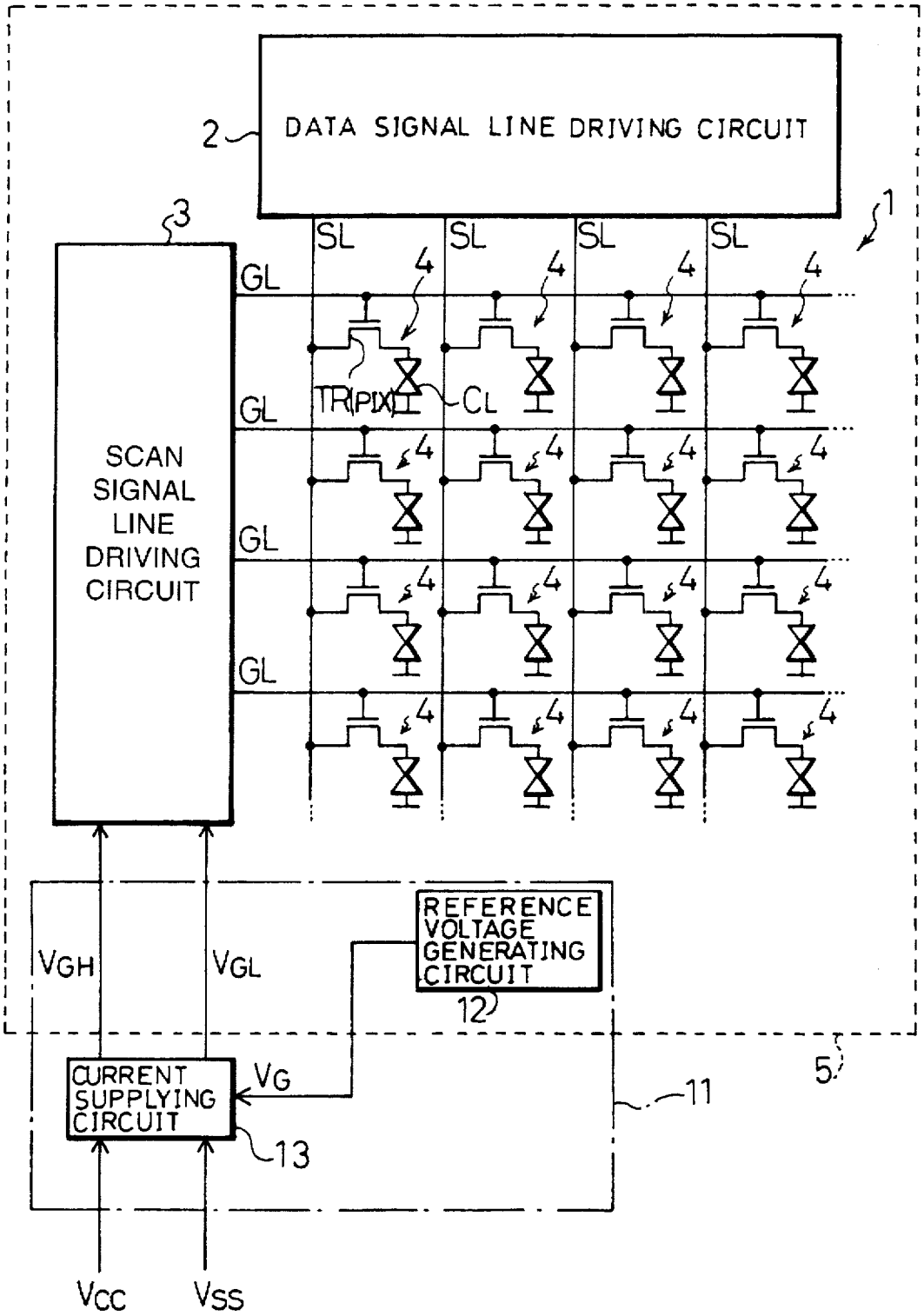
FIG. 1 is a block diagram which shows an arrangement of a main part of a liquid crystal display device according to embodiment 1 of the present invention.

The image display device of the present embodiment is a liquid crystal display device adopting an active matrix driving method, and as shown in FIG. 1, it has a picture element array 1, a data signal line driving circuit 2 and a scan signal line driving circuit 3. On the picture element array 1, a plurality of scan signal lines GL and a plurality of data signal lines SL are perpendicularly intersect each other. Moreover, a picture element 4 is provided to each area which is surrounded by two adjacent scan signal lines GL and two adjacent data signal lines SL. All of the picture elements 4 are arranged in a matrix pattern.

The picture element 4 has a picture element transistor $TR_{(PIX)}$ and a liquid crystal capacity $C_L$ as a liquid crystal element. The picture element transistor $TR_{(PIX)}$ is composed of a MOS-type FET (Field Effect Transistor), for example. Its gate is connected to the scan signal line GL, and its source is connected to the data signal line SL.

The data signal line driving circuit 2 samples an inputted analog video signal in synchronization with a timing signal having a constant period, and amplifies the sampled signal as necessary so as to supply it to each data signal line SL. The scan signal line driving circuit 3 successively selects the scan signal lines GL in synchronization with a timing signal so as to write data (video signal) supplied to each data signal line SL to each picture element 4 by controlling on/off operation of the picture element transistor $TR_{(PIX)}$ in the picture elements 4, and holds the written data.

A power supply voltage $V_{GH}$ of high level and a power supply voltage $V_{GL}$ of low level are applied to the scan signal line driving circuit 3 by the power supply circuit 11. The power supply circuit 11 has a reference voltage generating circuit 12 and a current supplying circuit 13, and more specifically it is arranged like a power supply circuit 11*a* shown in FIG. 2 or a power supply circuit 11*b* shown in FIG. 4, for example.

Figure 2:
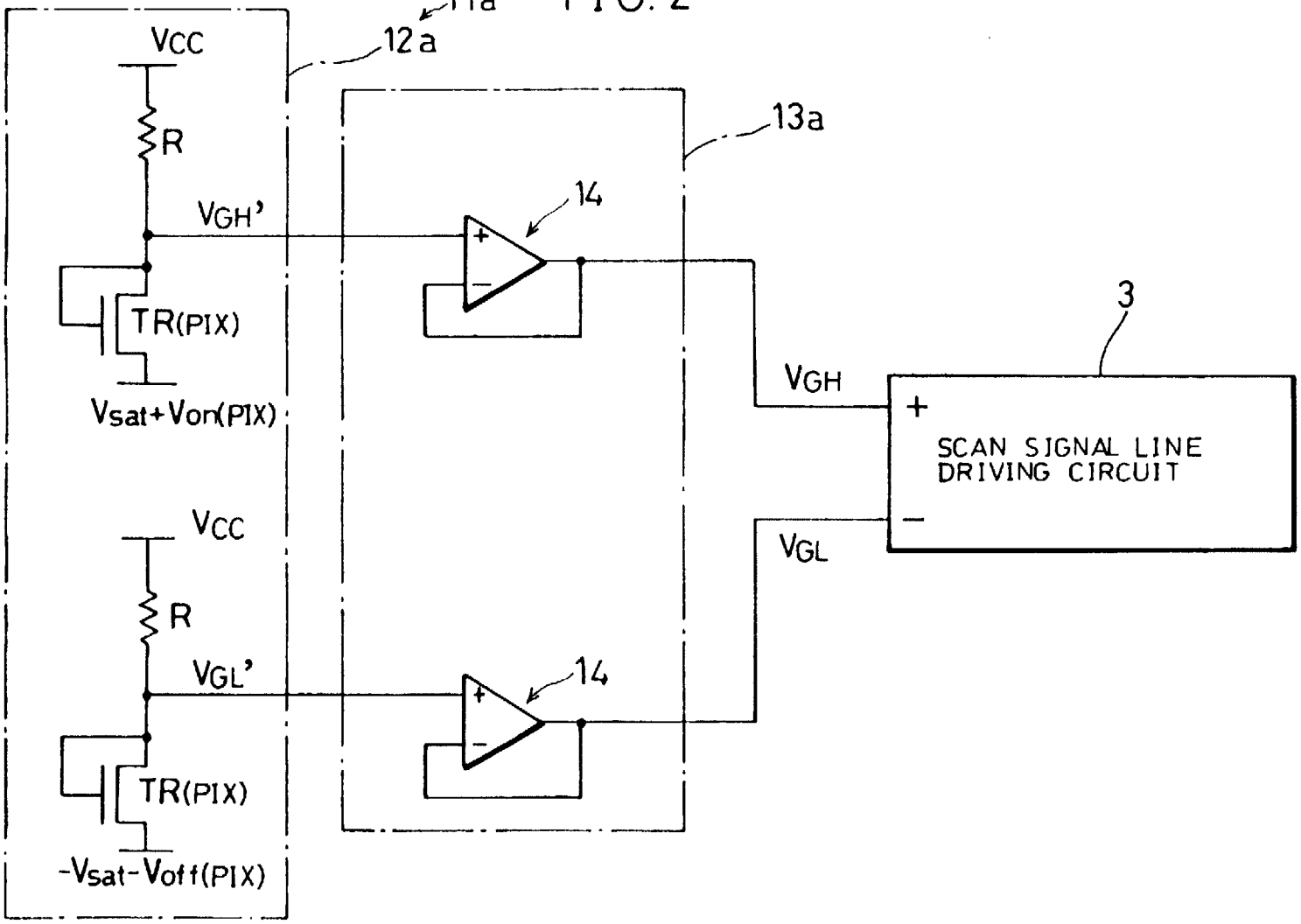
FIG. 2 is a circuit diagram which shows an arrangement of a power supply circuit in the liquid crystal display device of FIG. 1.

In the power supply circuit 11*a* shown in FIG. 2, the reference voltage generating circuit 12*a* has two circuits, which are composed of an n-type transistor ($TR_{(PIX)}$ of FIG. 2) with the same arrangement as that of the picture element transistor $TR_{(PIX)}$ and a resistance R with enough large resistance value, and these circuits respectively generate a reference voltage $V_{GH}'$ and a reference voltage $V_{GL}'$ according to a threshold voltage of the transistor $TR_{(PIX)}$.

In each circuit, the transistor $TR_{(PIX)}$ is connected to the resistance R in series, a gate electrode and a drain electrode of the transistor $TR_{(PIX)}$ are short-circuited, and a voltage $V_{CC}$ is applied to one terminal of the resistance R. Moreover, a voltage of $V_{sat}+V_{on(PIX)}$ is applied to the source electrode of the transistor $TR_{(PIX)}$ in one of the circuit, and a voltage of $-V_{sat}-V_{off(PIX)}$ is applied to the source electrode of the transistor $TR_{(PIX)}$ in the other circuit. Here, $V_{sat}$ is a saturation voltage of liquid crystal, and $V_{on(PIX)}$ and $V_{off(PIX)}$ are respectively an on-margin and an off-margin of the transistor $TR_{(PIX)}$.

In the reference voltage generating circuit 12*a*, when the gate electrode and the drain electrode of the transistor $TR_{(PIX)}$ are short-circuited by the enough high resistance R, a potential difference by only a threshold voltage $V_{th(PIX)}$ of the transistor $TR_{(PIX)}$ can be generated. Therefore, the reference voltage $V_{GL}'$ on the low potential side becomes higher than $-V_{sat}-V_{off(PIX)}$ by only the threshold voltage $V_{th(PIX)}$ of the picture element transistor $TR_{(PIX)}$. Meanwhile, the reference voltage $V_{GH}'$ on the high potential side becomes higher than $V_{sat}+V_{on(PIX)}$ by only $V_{th(PIX)}$.

The current supplying circuit 13*a* is provided with buffer amplifiers 14 in which an inversion input terminal and output terminal of an operational amplifier are short-circuited, and outputs a signal of the same level as that of an input signal. Therefore, the supply voltages $V_{GH}$ and $V_{GL}$ outputted from the current supplying circuit 13*a* have the same level as that of the reference voltages $V_{GH}'$ and $V_{GL}'$.

Figure 3:
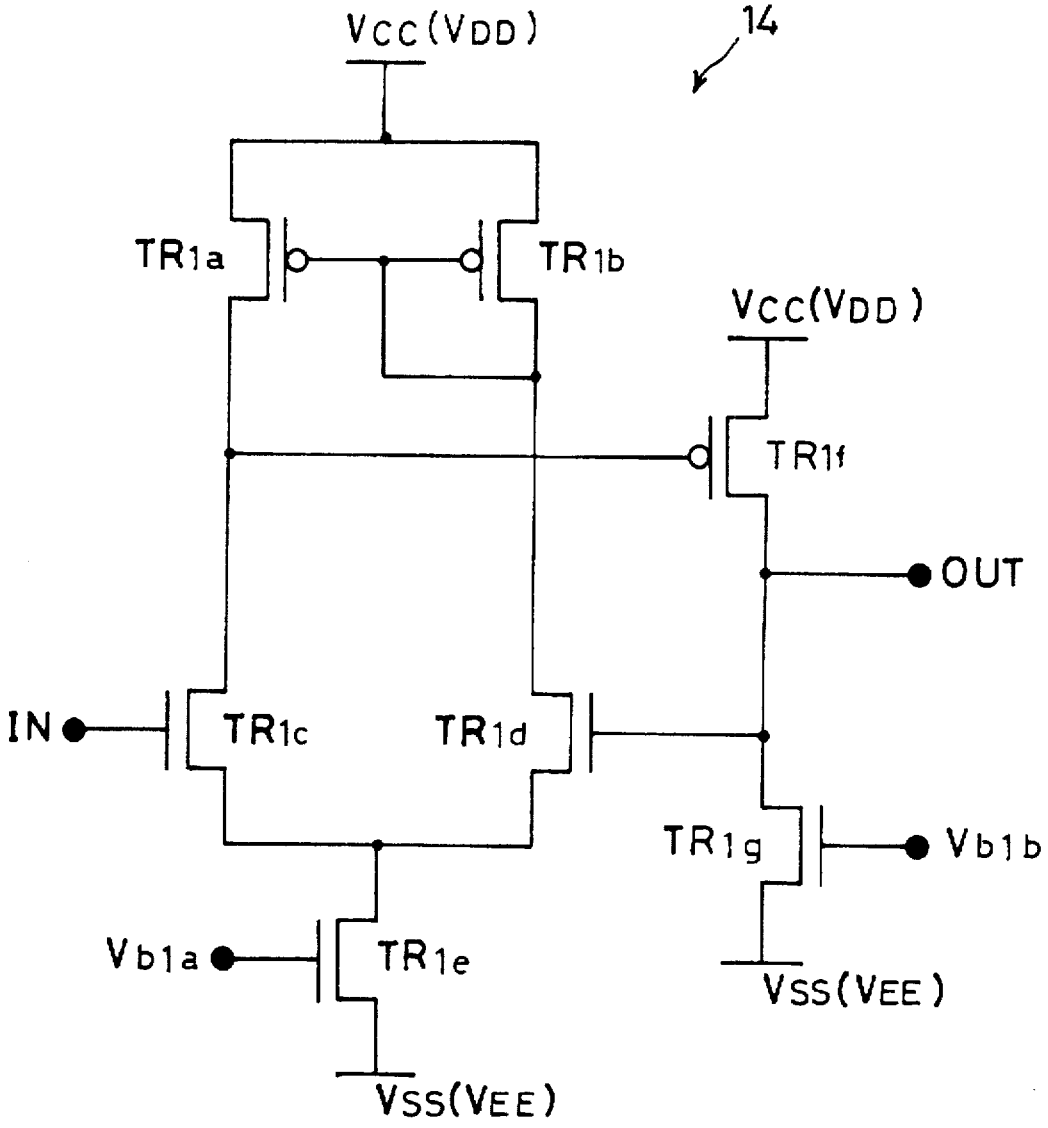
FIG. 3 is a circuit diagram which shows an arrangement of a buffer amplifier in the power supply circuit of FIG. 2.

As shown in FIG. 3, the buffer amplifier 14 is operated by operating voltages $V_{CC}(V_{DD})$ and $V_{SS}(V_{EE})$, and it has transistors $TR_{1a}$ through $TR_{1g}$. Bias voltages $V_{b1a}$ and $V_{b1b}$ are applied respectively to the transistors $TR_{1e}$ and $TR_{1g}$.

Figure 4:
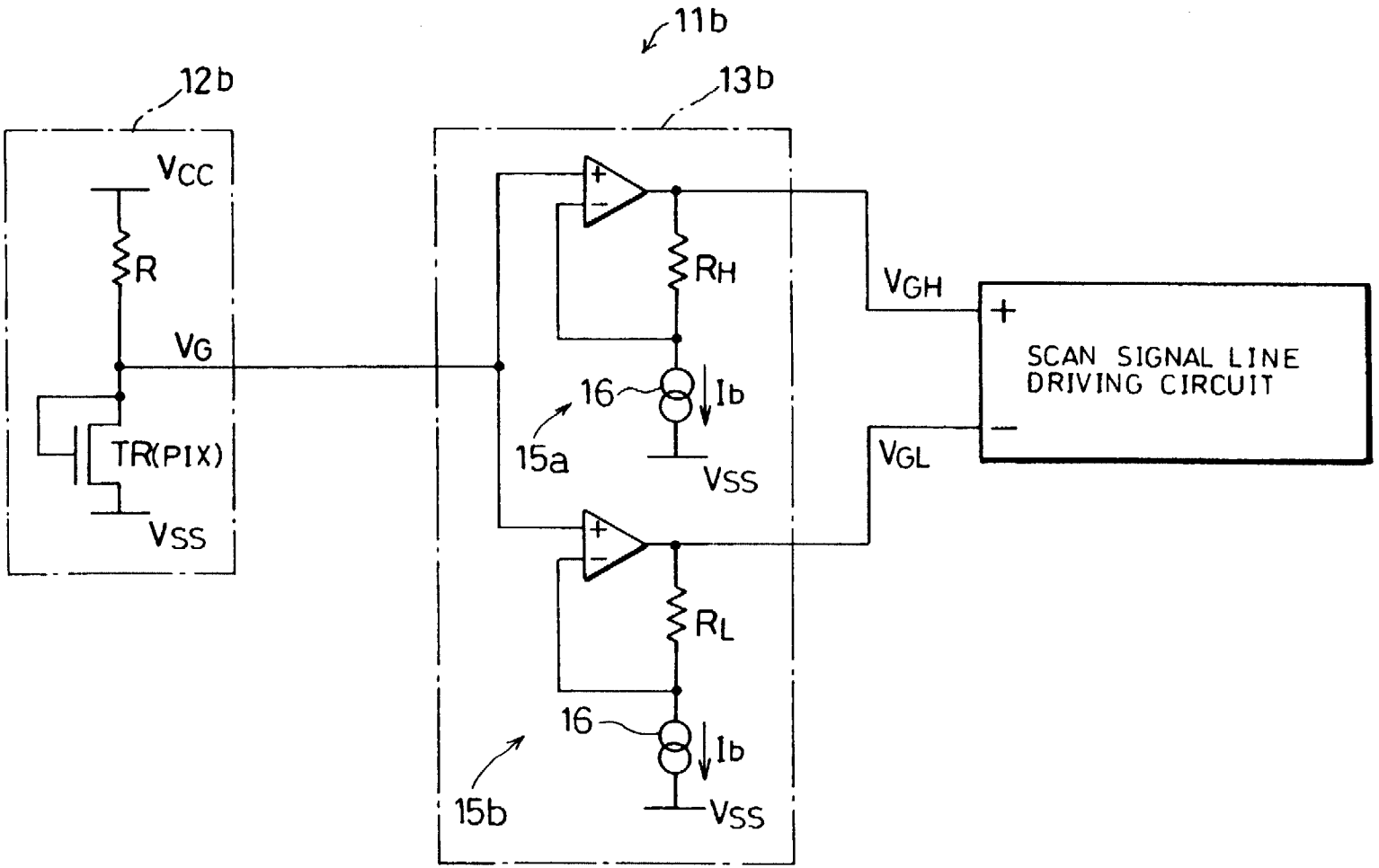
FIG. 4 is a circuit diagram which shows another arrangement of the power supply circuit in the liquid crystal display device of FIG. 1.

Meanwhile, in the power supply circuit 11*b* shown in FIG. 4, the reference voltage generating circuit 12*b* has one circuit which is equivalent to the circuit composed of the transistor $TR_{(PIX)}$ and the resistance R in the reference voltage generating circuit 12*a* shown in FIG. 2. The reference voltage generating circuit 12*b* generates a reference voltage $V_G$ which is higher than a certain constant voltage $V_{SS}$ by only the threshold voltage $Vth_{(PIX)}$.

The current supplying circuit 13*b* has two shift circuits 15*a* and 15*b*, and outputs the supply voltages $V_{GH}$ and $V_{GL}$ by shifting the reference voltage $V_G$. In the shift circuit 15*a* which outputs the supply voltage $V_{GH}$ on the high voltage side, the inversion input terminal and output terminal of the operational amplifier are connected via a resistance $R_H$, and in the shift circuit 15*b* which outputs the supply voltage $V_{GL}$ on the low voltage side, the inversion input terminal and output terminal of the operational amplifier are connected via a resistance $R_L$. Moreover, a constant current source 16 is connected to the resistances $R_H$ and $R_L$ in a series.

Figure 5:
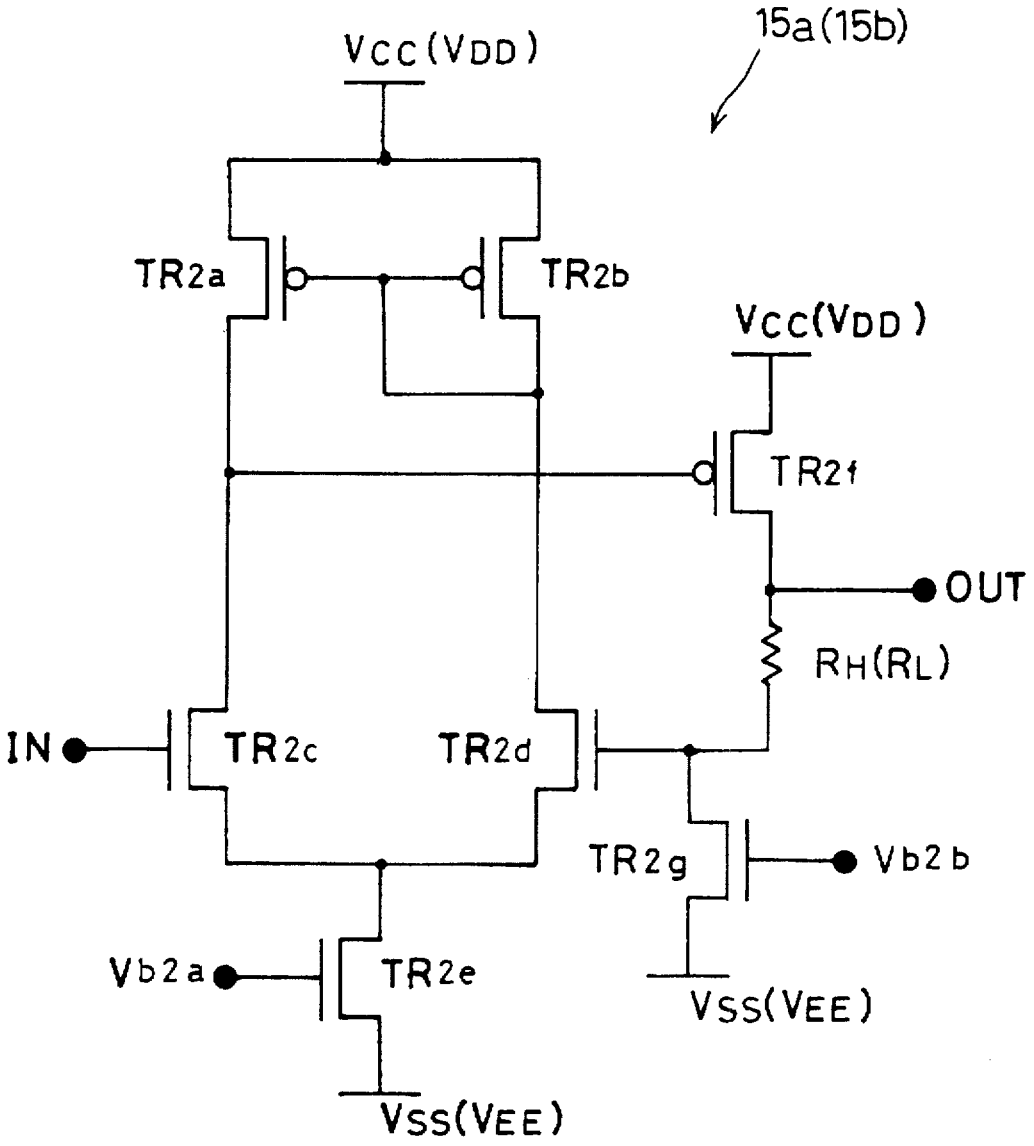
FIG. 5 is a circuit diagram which shows an arrangement of a shift circuit in the power supply circuit of FIG. 4.

In addition, as shown in FIG. 5, the shift circuit 15*a* (or 15*b*) is operated by operating voltages $V_{CC}(V_{DD})$ and $V_{SS}$ ($V_{EE}$), and it has transistors $TR_{2a}$ through $TR_{2g}$. Bias voltages $V_{b2a}$ and $V_{b2b}$ are applied respectively to the transistors $TR_{2e}$ and $TR_{2g}$.

A shifting amount of the voltages by the shift circuit 15*a* (15*b*) is obtained by the product of a resistance value $R_h$ ($R_1$) of the resistances $R_H$ ($R_L$) and a current $I_b$ of the constant current source 16. Therefore, when the resistance value $R_h$ ($R_1$) is selected so that the following equations are fulfilled:

$$I_b \times R_h = V_{sat} + V_{on(PIX)} - V_{SS}$$

$$I_b \times R_1 = -V_{sat} - V_{off(PIX)} - V_{SS},$$

the voltages are shifted by $I_b \times R_h$ and $I_b \times R_1$ so that the desired supply voltages VGH and VGL which are represented by the Equ. (1) can be obtained.

In addition, the arrangement of the power supply circuit 11 having the reference voltage generating circuit 12 and the current supplying circuit 13 is not necessarily limited to the arrangements shown in FIGS. 2 and 4, so another arrangement may be applicable.

The picture element array 1, the data signal line driving circuit 2, the scan signal line driving circuit 3 and the reference voltage generating circuit 12 are formed on one substrate 5. The substrate 5 is a glass substrate, and circuits to be formed thereon are composed of a polycrystal silicon thin film transistor formed at temperature of 300° C. to 600° C. Meanwhile, the current supplying circuit 13 is provided outside the substrate 5, and it is composed of an usual IC (integrated circuit), etc. formed on a monocrystal silicon substrate.

In addition, the circuits to be formed on the substrate 5 are not necessarily limited to a polycrystal silicon thin film transistor, so they may be a monocrystal silicon thin film transistor or an amorphous silicon thin film transistor.

In the case where different supply voltages are used in the scan signal line driving circuit 3 (for example, the shift registers, etc. are driven by a constant voltage and outputs are a high voltage via a level shifter, etc.), a driving voltage to be applied as the most suitable voltage by the power supply circuit 11 drives the output stage.

As mentioned above, in the present embodiment, the reference voltage generating circuit 12 is composed of a polycrystal silicon thin film transistor, etc. having the same arrangement as that of the picture element transistor $TR_{(PIX)}$ (namely, has the approximately same threshold voltage) and it is formed on the common substrate 5. As a result, the driving voltage, which corresponds with the threshold voltage $V_{th(PIX)}$ of the picture element transistor $TR_{(PIX)}$, can be applied to the scan signal line driving circuit 3. This can eliminate the variation in the threshold voltage between transistors due to different substrates, and thus the supply voltages do not require adjustment. Moreover, since the current supplying circuit 13 is composed of IC, the power supply circuit 11 whose ability to supply a current is high and whose output is stable can be provided.

In addition, in accordance with the above arrangement that the circuits to be formed on the substrate 5 are composed of thin film transistors, the characteristics of the thin film transistors are inferior to those of transistors composing an usual integrated circuit formed on a monocrystal silicon substrate in controllability (variation). However, as mentioned above, since the voltage does not require adjustment, a thin film transistor whose characteristics are inferior to those of a monocrystal silicon transistor can be efficiently put to practical use.

In addition, in the case where low-priced glass is used as the substrate 5 in order to enlarge a liquid crystal display device having a monolithic structure, a picture element should be formed at a temperature of not more than the distortion point of the glass (about 600° C.). However, the picture element formed by such a process is inferior to a polycrystal silicon thin film transistor formed at a higher temperature in characteristics. Even in this case, similarly to the above case, the polycrystal silicon thin film transistor with inferior characteristics can be efficiently put to practical use. Here, in the present technique, since the lower limit temperature where a silicon film can be layered is 300° C., the above polycrystal silicon thin film transistor is formed at temperature of not less than 300° C.

In the present embodiment, the transistor $TR_{(PIX)}$ in the reference voltage generating circuit 12 has the same arrangement as that of the picture element transistor $TR_{(PIX)}$, but it is not necessarily limited to this arrangement. In other words, the transistor $TR_{(PIX)}$ can have any arrangement as long as the threshold voltages are approximate equal. This is applicable to the embodiment 2, mentioned later.

Figure 6:
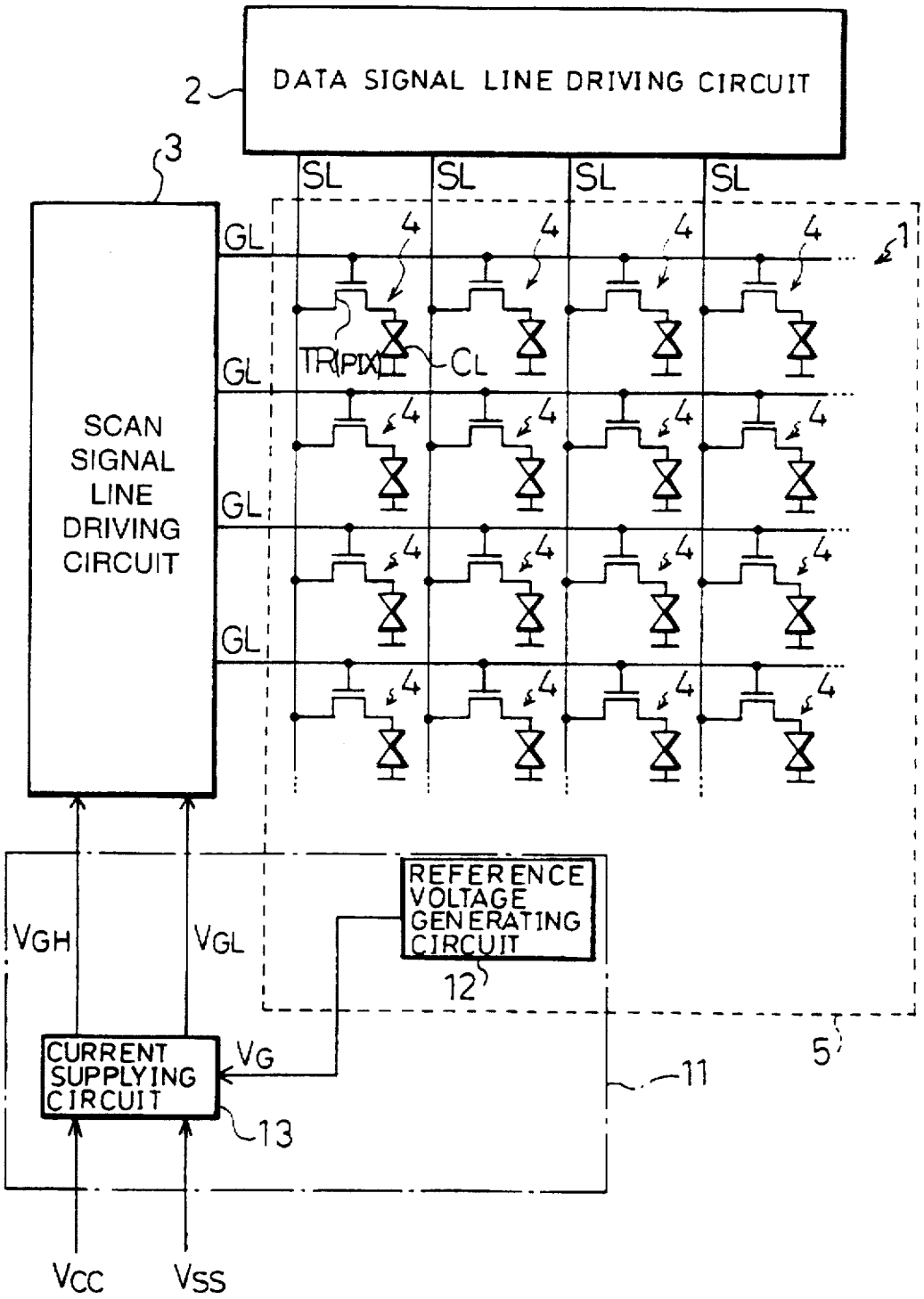
FIG. 6 is a block diagram which shows an arrangement of a main part of a liquid crystal display device according to first modified example of embodiment 1 of the present invention.

As shown in FIG. 6, the first modified example of the present embodiment is different from the arrangement shown in FIG. 1 in that the data signal line driving circuit 2 and the scan signal line driving circuit 3 are not formed on the substrate 5.

In the present modified example, since the reference voltage generating circuit 12 contains a picture element which is similar to that of the picture element transistor $TR_{(PIX)}$, the reference voltage generating circuit 12 generates the reference voltages $V_{GH}'$, $V_{GL}'$ or $V_G$ according to the threshold voltage $Vth_{(PIX)}$ so as to be capable of outputting them to a current supplying circuit 3.

Figure 7:
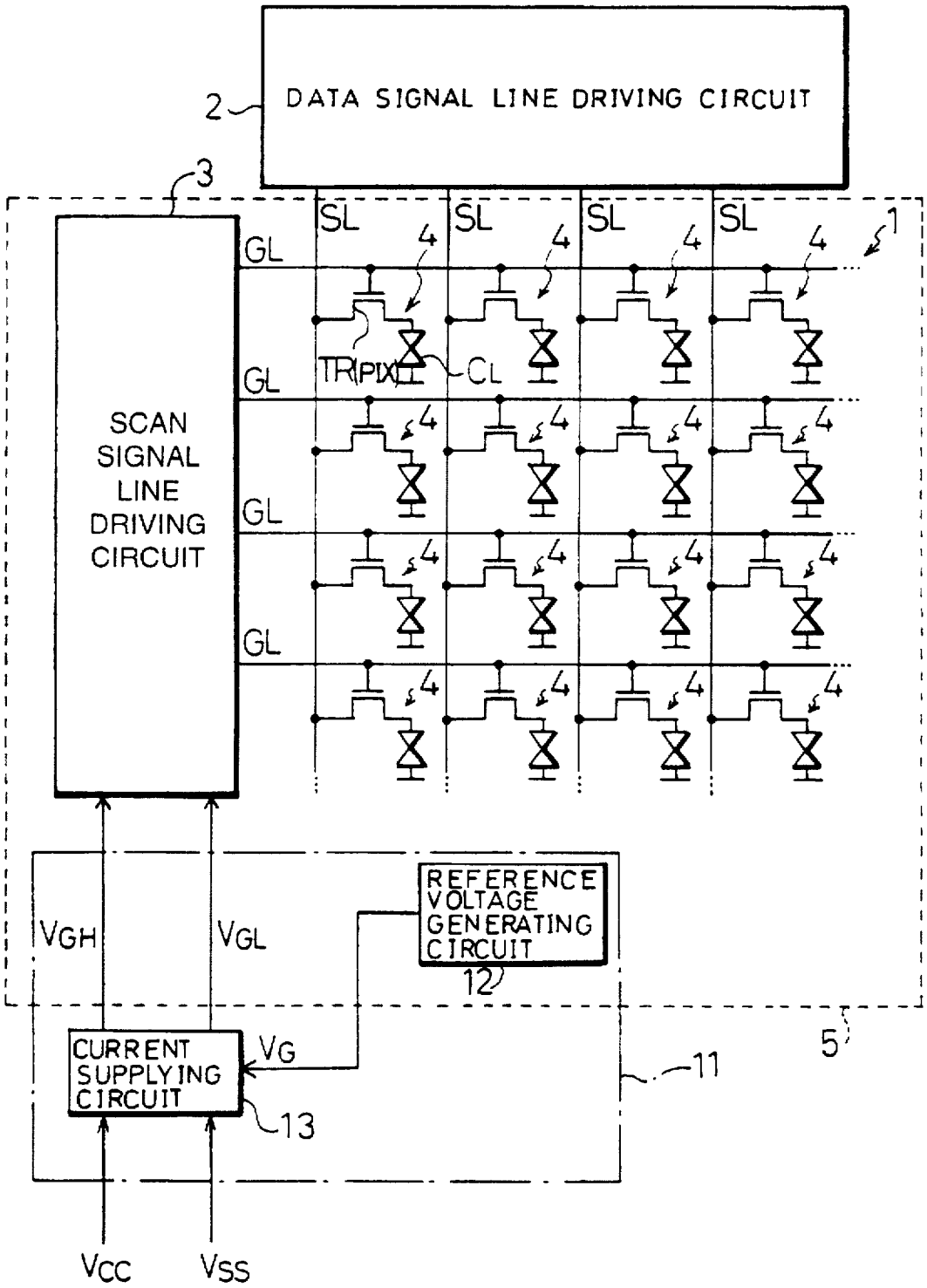
FIG. 7 is a block diagram which shows an arrangement of a main part of a liquid crystal display device according to second modified example of embodiment 1 of the present invention.

As shown in FIG. 7, the second modified example of the present embodiment is different from the first modified example in that the scan signal line driving circuit 3 is formed on the substrate 5 and the data signal line driving circuit 2 is not formed on the substrate 5.

Also in the present modified example, the reference voltage generating circuit 12 includes elements which is approximately equal to the picture element transistor $TR_{(PIX)}$, the same effects which are same as the above modified example 1 can be obtained.

[EMBODIMENT 2]

Figure 8:
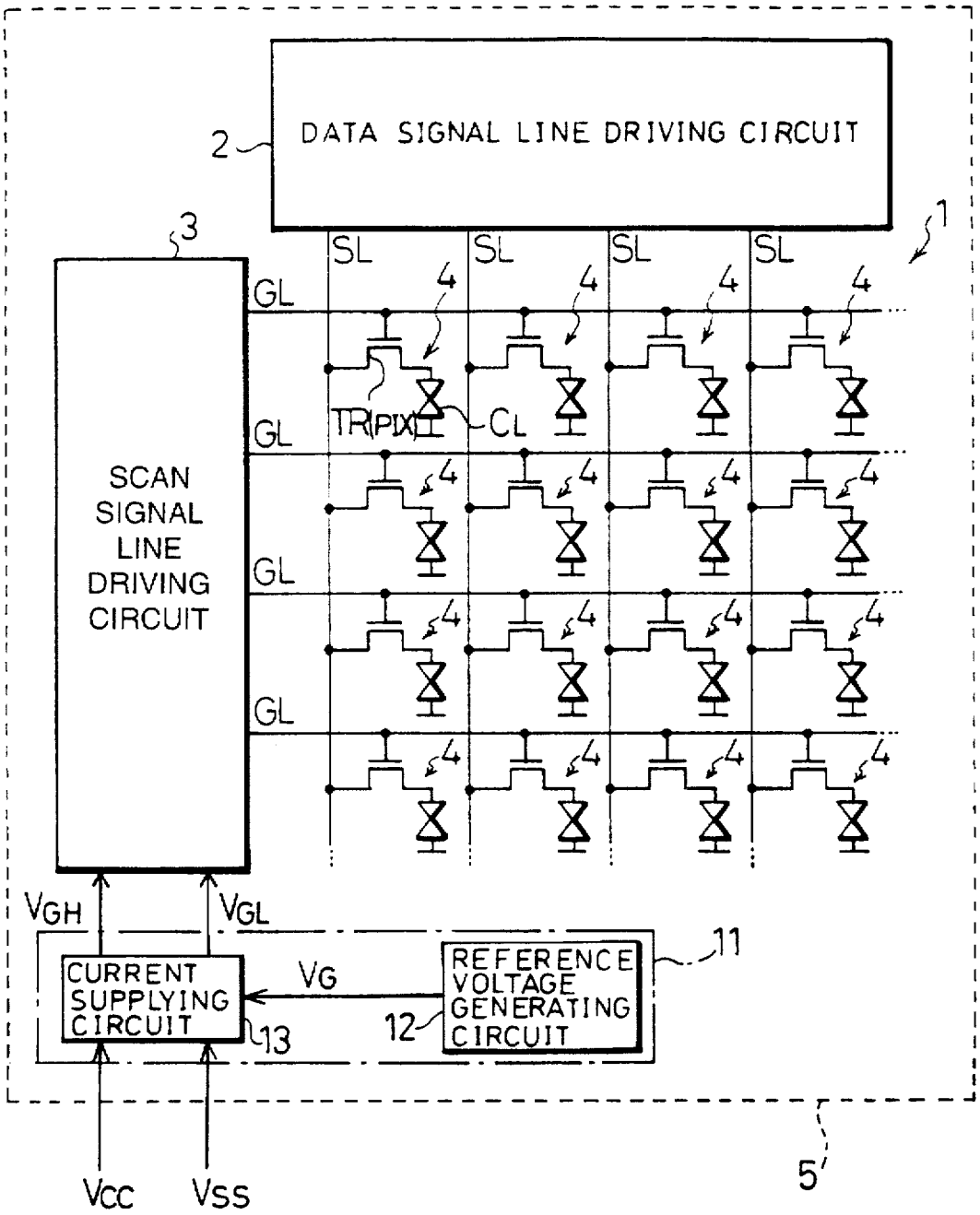
FIG. 8 is a block diagram which shows an arrangement of a main part of a liquid crystal display device according to embodiment 2 of the present invention.

The following describes embodiment 2 of the present invention in reference to FIG. 8. Here, for convenience of explanation, those members that have the same arrangement and functions, and that are described in the aforementioned embodiment 1 are indicated by the same reference numerals and the description thereof is omitted.

As shown in FIG. 8, in the liquid crystal display device of the present embodiment, the current supplying circuit 13 of the power supply circuit 11 as well as the picture element 1, the data signal line driving circuit 2, the scan signal line driving circuit 3 and the reference voltage generating circuit 12 is formed on one substrate 5. All the circuits formed on the substrate 5 are composed of polycrystal, monocrystal or amorphous silicon thin film transistor.

As mentioned above, in the present embodiment, since not only the reference voltage generating circuit 12 but also the current supplying circuit 13 are composed of a polycrystal silicon thin film transistor which is same as the picture element transistor $TR_{(PIX)}$, the driving voltage, which corresponds with the threshold voltage $V_{th(PIX)}$ of the picture element transistor $TR_{(PIX)}$, can be applied to the scan signal line driving circuit 3. Moreover, since the current supplying circuit 13 as well as the reference voltage generating circuit 12 is formed on the substrate 5, it is not necessary to provide signal lines and power lines outside the substrate 5 between the reference voltage generating circuit 12 and the current supplying circuit 13, thereby making it possible to provide an image display panel having fewer external terminals.

[EMBODIMENT 3]

The following describes the third embodiment of the present invention in reference to FIGS. 3, 5, 9 through 13. Here, for convenience of explanation, those members that have the same arrangement and functions, and that are described in the aforementioned embodiment 1 are indicated by the same reference numerals and the description thereof is omitted.

Figure 9:
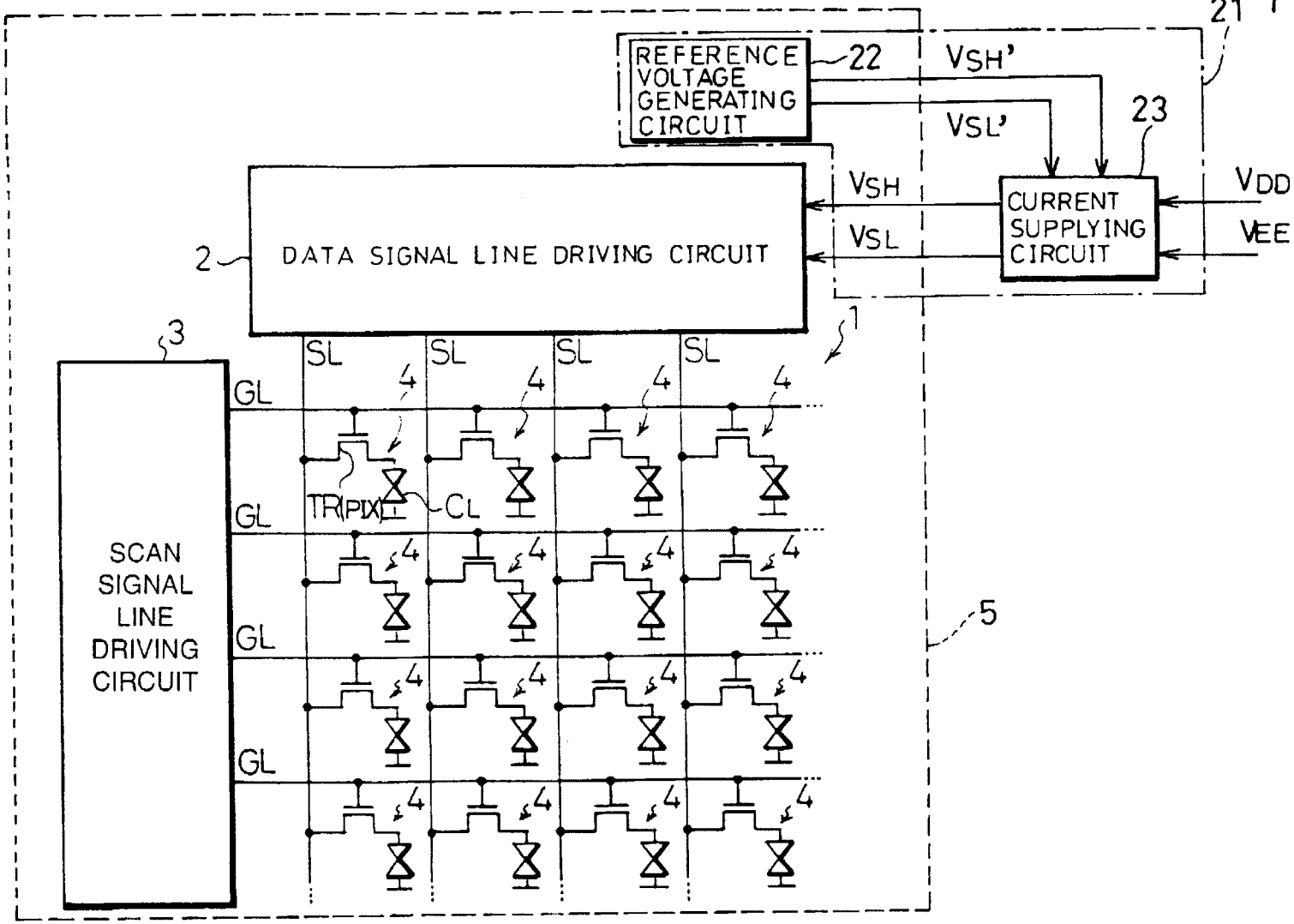
FIG. 9 is a block diagram which shows an arrangement of a main part of a liquid crystal display device according to embodiment 3 of the present invention.

As shown in FIG. 9, in the liquid crystal display device of the present embodiment, a supply voltage $V_{SH}$ of high level and a supply voltage $V_{SL}$ of low level are applied to the data signal line driving circuit 2 by a power supply circuit 21. The power supply circuit 21 has a reference voltage generating circuit 22 and a current supplying circuit 23, and more specifically, the power supply circuit 21 is arranged like a power supply circuit **21*a* shown in FIGS. 10 or a power supply circuit 21*b* shown in FIG. 11**.

Figure 10:
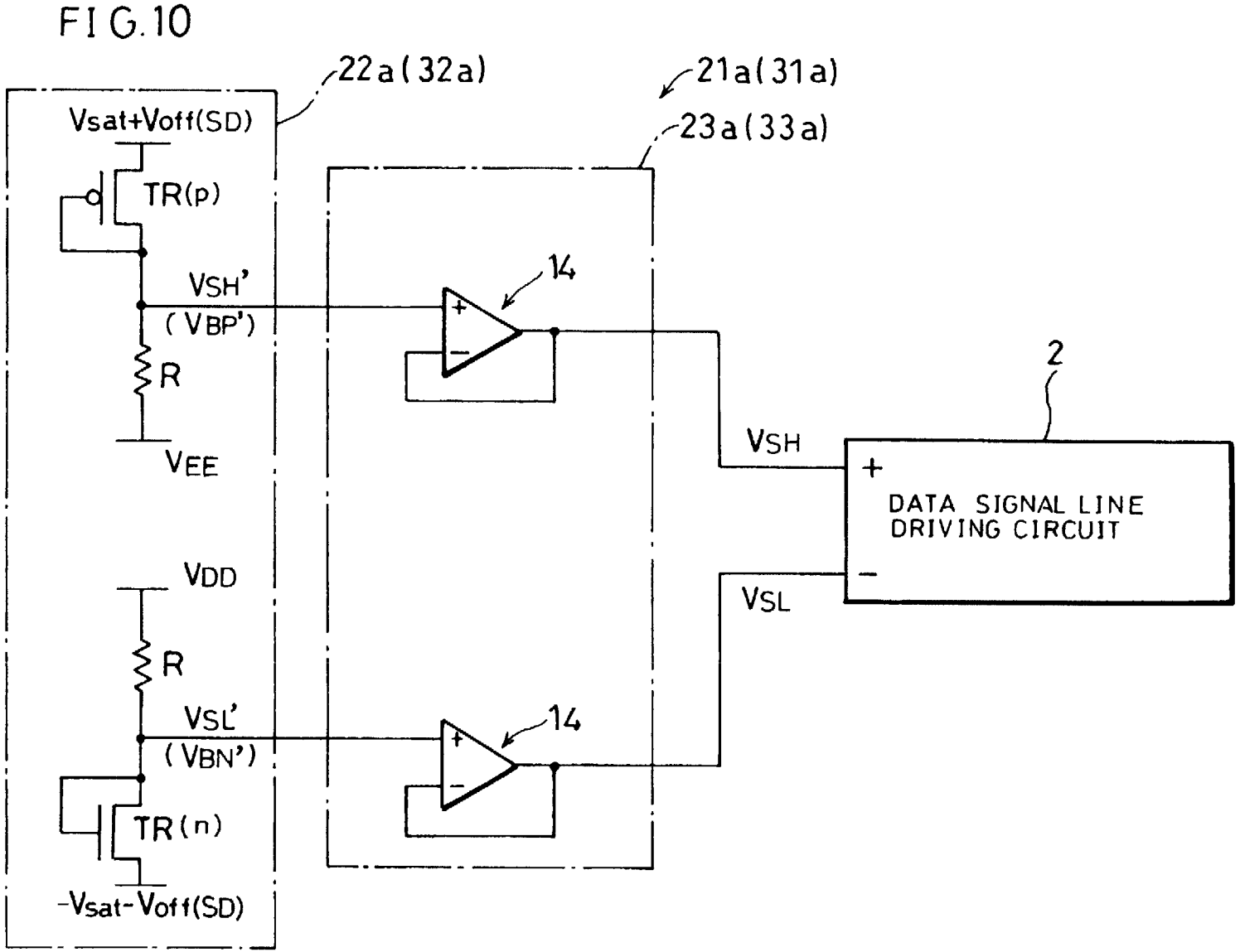
FIG. 10 is a circuit diagram which shows an arrangement of a power supply circuit in the liquid crystal display device of FIG. 9.

In the power supply circuit **21*a* shown in FIG. 10, the reference voltage generating circuit 22*a* has two circuits, which are composed of transistors $TR_{(n)}$ and $TR_{(p)}$ having the same configuration as that of the transistors (not shown) composing the data signal line driving circuit 2**, and the resistances R with enough large resistance value. The two circuits generates reference voltages $V_{SH}'$ and $V_{SL}'$ according to the threshold voltages of the transistors $TR_{(n)}$ and $TR_{(p)}$ in each circuit.

In the circuit which generates the reference voltage $V_{SL}'$ on the low voltage side, the transistor $TR_{(n)}$ and the resistance R are connected in series. A voltage $-V_{sat}-V_{off(SD)}$ is applied to the source electrode of the transistor $TR_{(n)}$, and a voltage $V_{DD}$ is applied to one terminal of the resistance R. Meanwhile, in the circuit which generates the reference voltage $V_{SH}'$ on the high voltage side, the transistor $TR_{(p)}$ and the resistance R are connected in series. A voltage $V_{sat}+V_{off(SD)}$ is applied to the source electrode of the transistor $TR_{(p)}$, and a voltage $V_{EE}$ is applied to one terminal of the resistor R. Moreover, in the transistors $TR_{(n)}$ and $TR_{(p)}$, the gate electrode and the drain electrode are short-circuited. The $V_{off(SD)}$ is an off-margin of the transistors $TR_{(n)}$ and $TR_{(p)}$.

When the gate electrodes and the drain electrodes of the transistors $TR_{(n)}$ and $TR_{(p)}$ are short-circuited by the resistances R with enough large resistance value, the reference voltage generating circuit **22*a*** can generates a potential difference only by the threshold voltages of the transistor $TR_{(n)}$ and $TR_{(p)}$. Therefore, the reference voltage $V_{SL}'$ on the low potential side becomes higher than $-V_{sat}-V_{off(SD)}$ only by the threshold voltage $V_{th(n)}$ of the transistor $TR_{(n)}$. Meanwhile, the reference voltage $V_{SH}'$ on the high potential side becomes lower than $V_{sat}+V_{off(SD)}$ by the threshold voltage $V_{th(p)}$.

The current supplying circuit **23*a* is provided with the buffer amplifiers 14 with the arrangement shown in FIG. 3, and it outputs a signal of the same level as that of an input signal. Therefore, the supply voltages $V_{SH}$ and $V_{SL}$ to be output from the current supplying circuit 23a** have the same level as that of the reference voltages $V_{SH}'$ and $V_{SL}'$.

Figure 11:
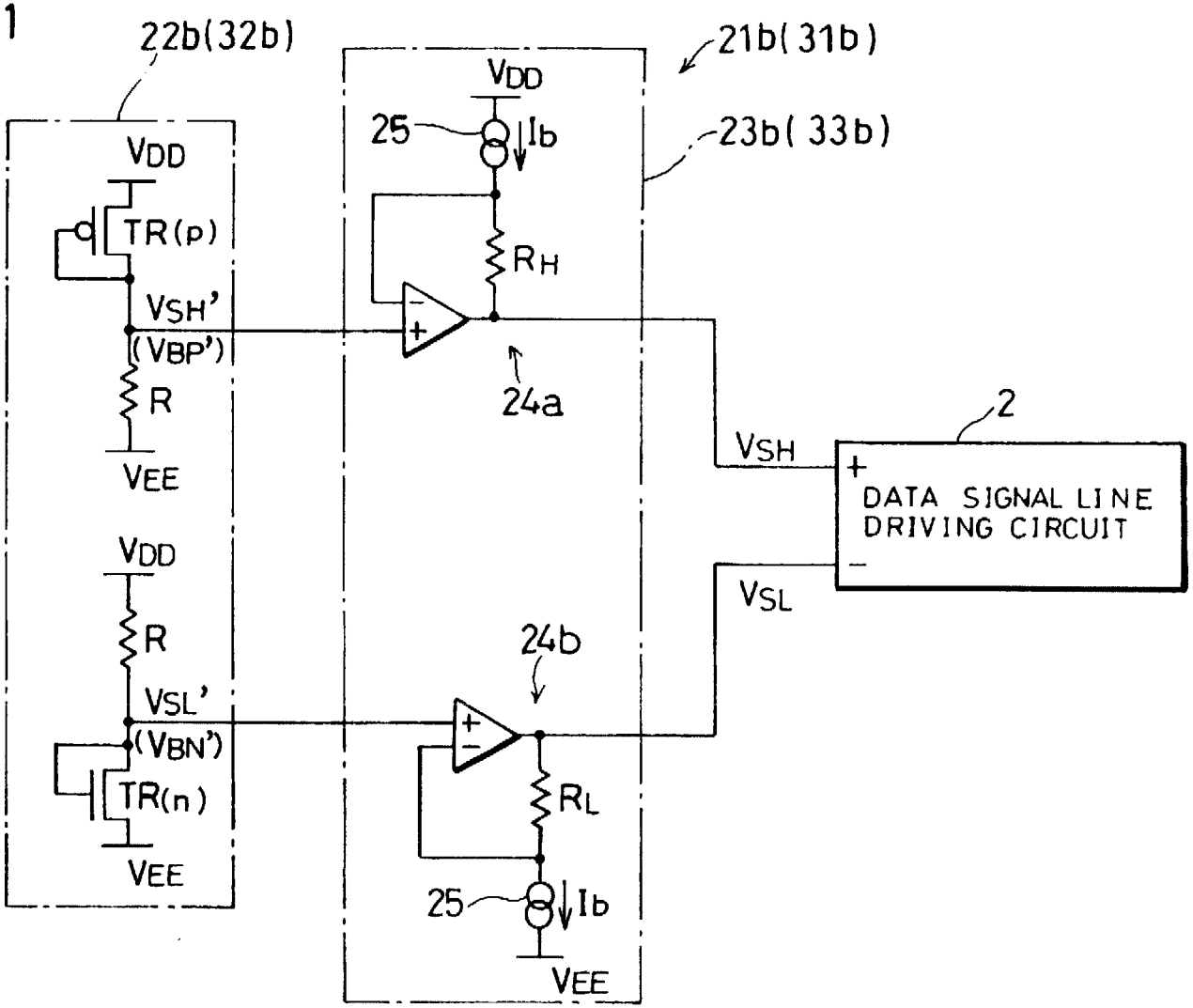
FIG. 11 is a circuit diagram which shows another arrangement of the power supply circuit in the liquid crystal display device of FIG. 9.

Meanwhile, in the power supply circuit 21b shown in FIG. 11, the reference voltage generating circuit 22b has a circuit, which is equivalent to the circuit in the reference voltage generating circuit 22a shown in FIG. 10. In the reference voltage generating circuit 22b, a voltage $V_{EE}$ is applied to the source electrode of the transistor $TR_{(n)}$ in the circuit on the low voltage side, and a voltage $V_{DD}$ is applied to the source electrode of the transistor $TR_{(p)}$ in the circuit on the high voltage side. The reference voltage generating circuit 22b generates the reference voltage $V_{SL}'$, which is higher than a certain constant voltage $V_{EE}$ only by the threshold voltage $V_{th(n)}$, and the reference voltage $V_{SH}'$, which is lower than a certain constant voltage $V_{DD}$ only by the threshold voltage $V_{th(p)}$.

The current supplying circuit 23b has two shift circuits 24a and 24b. The shift circuits 24a and 24b shift the reference voltages $V_{SH}'$ and $V_{SL}'$ so as to output the supply voltages $V_{SH}$ and $V_{SL}$. In the shift circuit 24a which outputs the supply voltage $V_{SH}$ on the high voltage side, the inversion input terminal and output terminal of an operational amplifier are connected via the resistance $R_H$, and the constant current source 25 to which the voltage $V_{DD}$ is applied is connected to the resistance $R_H$ in series. Meanwhile, in the shift circuit 24b which outputs the supply voltage $V_{SL}$ on the low voltage side, the inversion input terminal and output terminal of an operational amplifier are connected via the resistance $R_L$, and the constant current source 25 to which the voltage $V_{EE}$ is applied is connected to the resistance $R_L$ in series.

Figure 12:
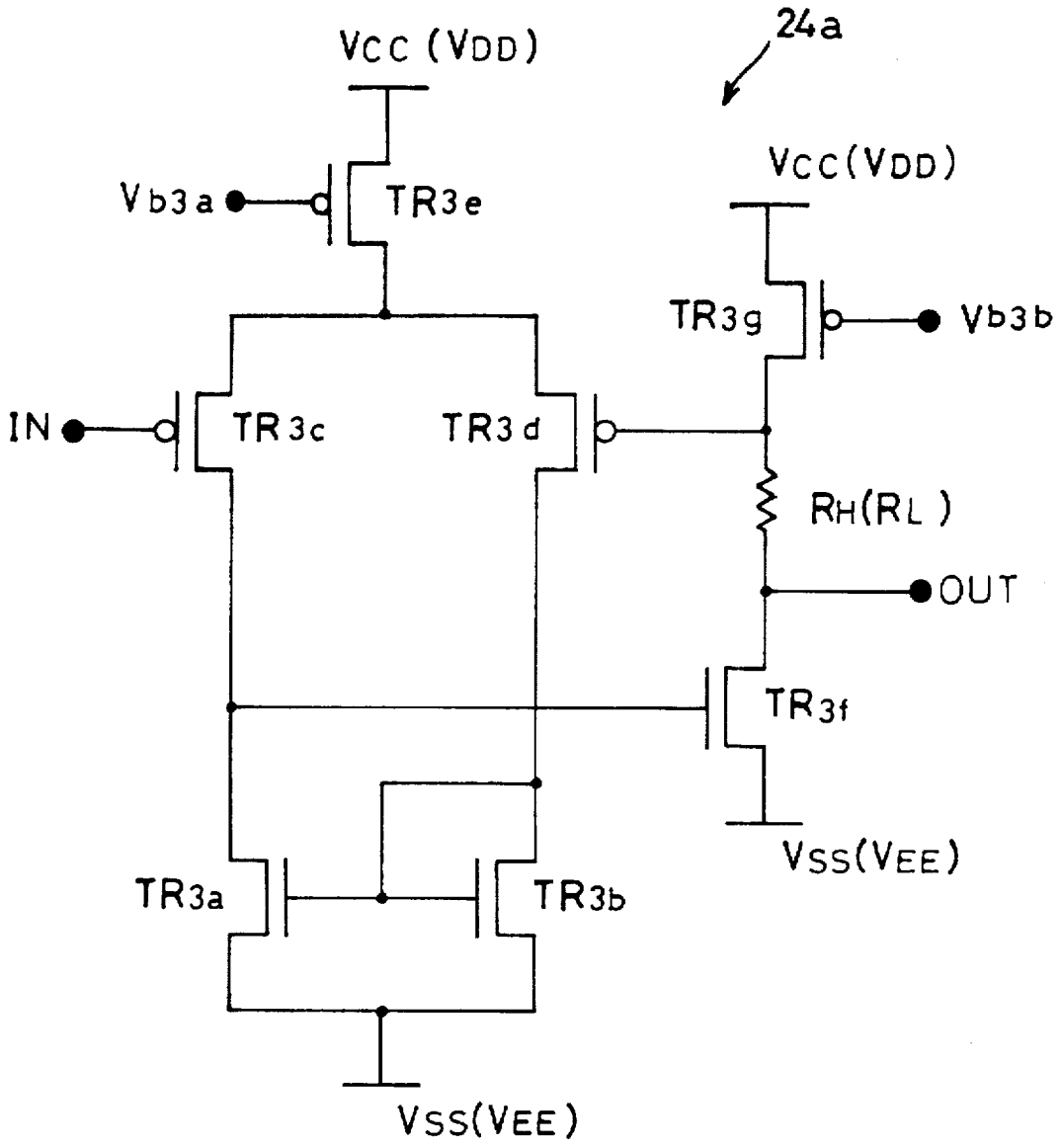
FIG. 12 is a circuit diagram which shows an arrangement of a shift circuit in the power supply circuit of FIG. 11.

In addition, as shown in FIG. 12, the shift circuit 24a is operated by operating voltages $V_{CC}(V_{DD})$ and $V_{SS}(V_{EE})$, and it has transistors $TR_{3a}$ through $TR_{3g}$. Bias voltages $V_{b3a}$ and $V_{b3b}$ are applied to the transistors $TR_{3e}$ and $TR_{3g}$. Moreover, the arrangement of the shift circuit 24b is shown in FIG. 5.

A shifting amount of the voltages by the shift circuit 24a is obtained by the product of a resistance value $R_h$ ($R_1$) of the resistance $R_H$ ($R_L$) and the current $I_b$ of the constant current source 25. Therefore, when the resistance value $R_h$ ($R_1$) is selected so that the following relationships are fulfilled:

$$I_b \times R_h = V_{sat} + V_{off(SD)} - V_{DD}$$

$$I_b \times R_1 = -V_{sat} - V_{Off(SD)} - V_{EE},$$

the voltages are shifted by $-I_b \times R_h$ and $+I_b \times R_1$ so that desired supply voltages $V_{SH}$, and $V_{SL}$, which are represented by the Equ. (2) can be obtained.

In addition, the arrangement of the power supply circuit 21 having the reference voltage generating circuit 22 and the current supplying circuit 23 is not necessarily limited to the arrangements shown in FIGS. 10 and 11, so another arrangement may be applicable.

The picture element array 1, the data signal line driving circuit 2, the scan signal line driving circuit 3 and the reference voltage generating circuit 22 are formed on one substrate 5. The circuits formed on the substrate 5 are composed of a polycrystal silicon thin film transistor, that is formed at temperature of 300° C. to 600° C. Meanwhile, the current supplying circuit 23 is provided outside the substrate 5, and it is composed of an usual IC, etc. formed on a monocrystal silicon substrate.

In addition, the circuits formed on the substrate 5 are not necessarily limited to a polycrystal silicon thin film transistor, so it can be a monocrystal silicon thin film transistor or an amorphous silicon thin film transistor.

In the case where different supply voltages are used in the data signal line driving circuit 2 (for example, the shift registers, etc. are driven by a constant voltage and the outputs are driven by a high voltage via the level shifters, etc.), driving voltages to be supplied as the most suitable voltages by the power supply circuit 21 drive the output stage.

As mentioned above, in the present embodiment, the reference voltage generating circuit 22 is composed of a polycrystal silicon thin film transistor, etc. which is the same configuration as that in the data signal line driving circuit 2 (namely, has approximately equal threshold voltage), and the reference voltage generating circuit 22 is formed on the common substrate 5. As a result, the driving voltage, which corresponds with the threshold voltage of the transistors composing the data signal line driving circuit 2 (especially, the sampling switch), can be applied to the data signal line driving circuit 2. This can eliminate influence of the variations in the threshold voltage between the transistors due to different substrates, so the supply voltage does not require adjustment. Moreover, the current supplying circuit 23 is composed of an IC, thereby making it possible to provide the power supply circuit 21 whose ability to supply a current is high and whose output is stable.

In the present embodiment, the transistors $TR_{(n)}$ and $TR_{(p)}$ in the reference voltage generating circuit 22 have the same configuration as that of the transistors in the data signal line driving circuit 2, but the configuration is not necessarily limited to this. Therefore, any configuration is applicable to the transistors $TR_{(n)}$ and $TR_{(p)}$ as long as the threshold voltages are approximately equal.

Figure 13:
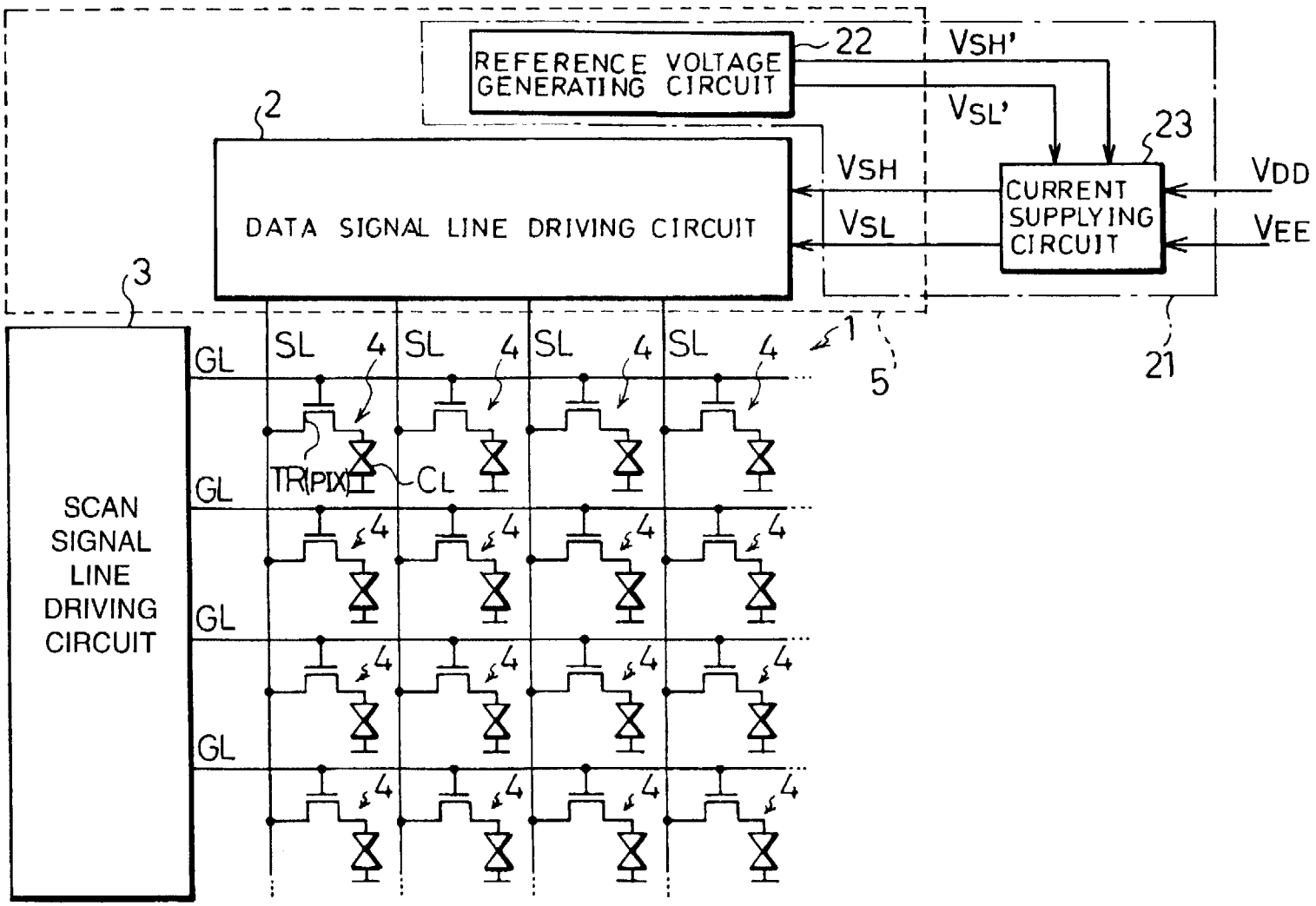
FIG. 13 is a block diagram which shows an arrangement of the main part of the liquid crystal display device according to a modified example of embodiment 3 of the present invention.

As shown in FIG. 13, the modified example of the present embodiment is different from the arrangement shown in FIG. 9 in that the scan signal line driving circuit 3 and the picture element array 1 are not formed on the substrate 5.

In the present modified example, since the reference voltage generating circuit 22 contains the same picture elements as those of the transistors composing the data signal line driving circuit 2, it generates the reference voltages $V_{SH}'$ and $V_{SL}'$ according to the threshold voltages so as to be capable of outputting them to the current supplying circuit 23.

[EMBODIMENT 4]

Figure 14:
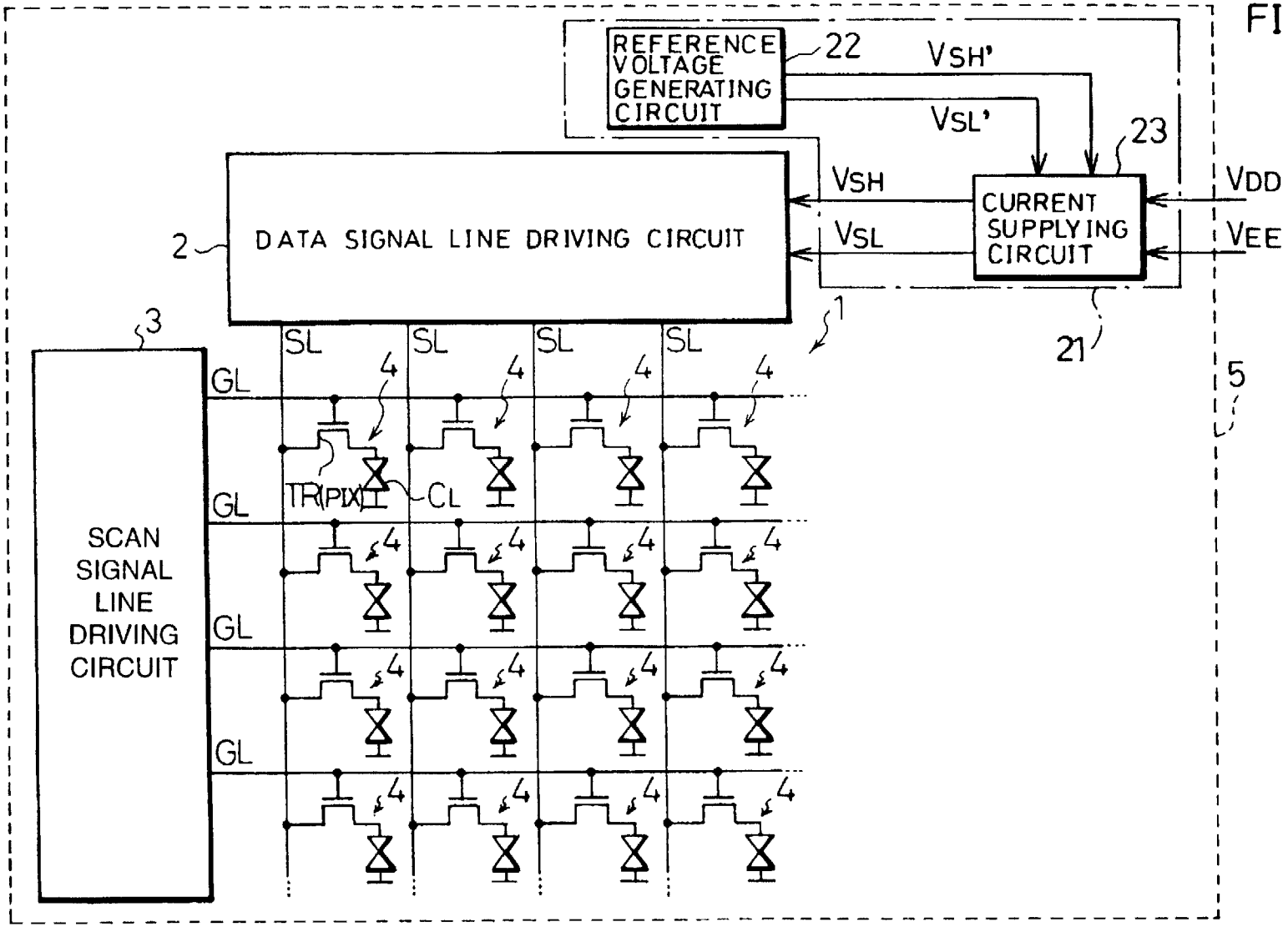
FIG. 14 is a block diagram which shows an arrangement of a main part of a liquid crystal display device according to embodiment 4 of the present invention.

The following describes the fourth embodiment of the present invention in reference to FIG. 14. Here, for convenience of explanation, those members that have the same arrangement and functions, and that are described in the aforementioned embodiment 3 are indicated by the same reference numerals and the description thereof is omitted.

As shown in FIG. 14, in the liquid crystal display device of the present embodiment, the current supplying circuit 23 of the power supply circuit 21 as well as the picture element array 1, the data signal line driving circuit 2, the scan signal line driving circuit 3 and the reference voltage generating circuit 22 is formed on one substrate 5. All the circuits formed on the substrate 5 are composed of a polycrystal, monocrystal or amorphous silicon thin film transistor.

As mentioned above, in the present embodiment, since not only the reference voltage generating circuit 22 but also the current supplying circuit 23 is composed of a polycrystal silicon thin film transistor having the same configuration as that in the data signal line driving circuit 2, a driving voltage, which corresponds with the threshold voltage of the transistors composing the data signal line driving circuit 2, can be applied to the data signal line driving circuit 2. Moreover, since the current supplying circuit as well as the reference voltage generating circuit 22 is formed on the substrate 5, it is not necessary to provide signal lines and power lines outside the substrate 5 between the reference voltage generating circuit 22 and the current supplying circuit 23, thereby making it possible to provide an image display panel having fewer external terminals.

In the present embodiment, any configuration may be applicable to the transistors $TR_{(n)}$ and $TR_{(p)}$ in the reference voltage generating circuit 22 as long as their threshold voltage is approximately equal to that of the transistors in the data signal line driving circuit 2. Moreover, the circuits formed on the substrate 5 may be composed of a monocrystal silicon thin film transistor or an amorphous silicon thin film transistor.

[EMBODIMENT 5]

The following describes the fifth embodiment of the present invention in reference to FIGS. 10, 11, 15 through 18. Here, for convenience of explanation, those members that have the same arrangement and functions, and that are described in the aforementioned embodiments 1 and 3 are indicated by the same reference numerals and the description thereof is omitted.

Figure 15:
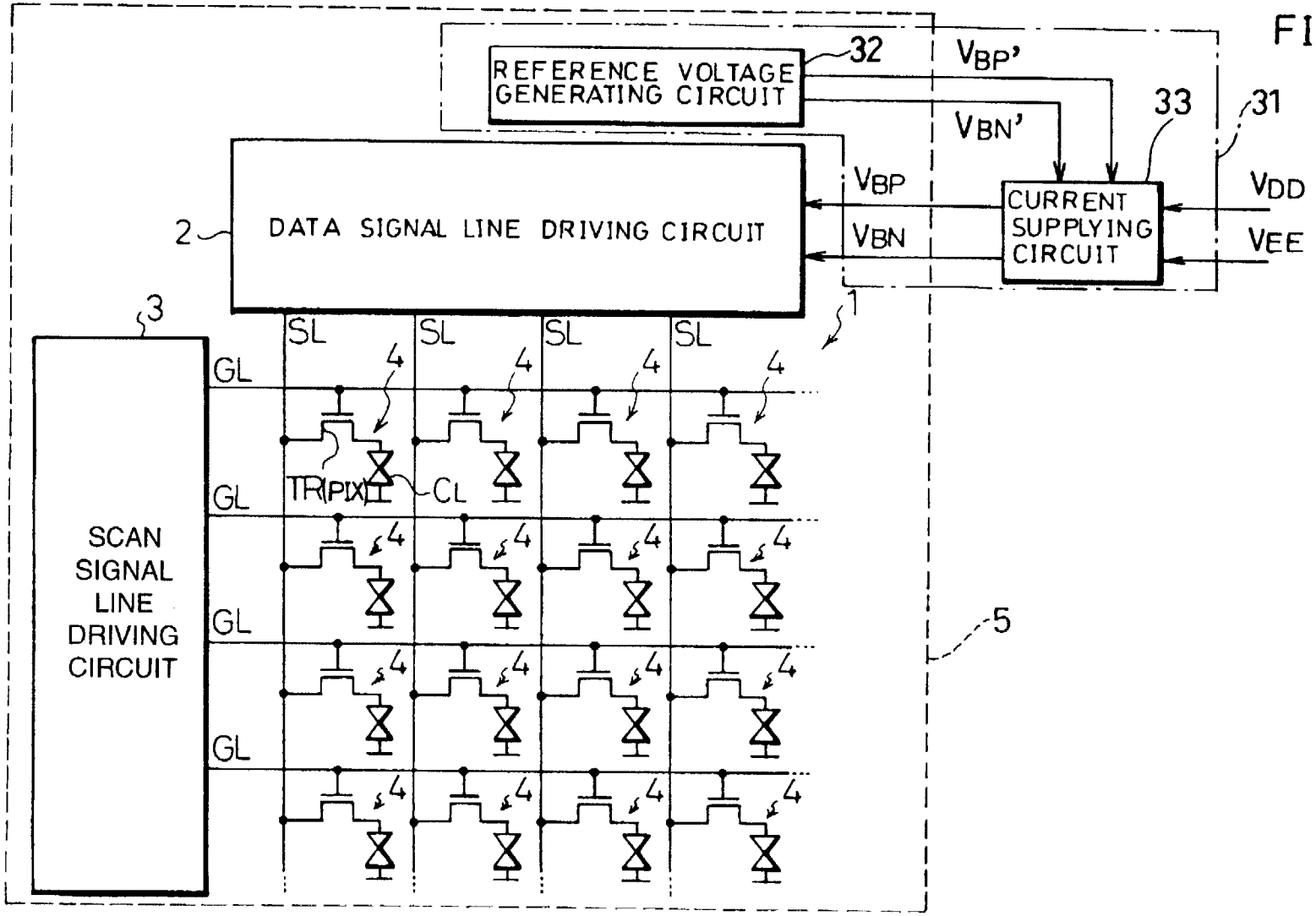
FIG. 15 is a block diagram which shows an arrangement of a main part of a liquid crystal display device according to embodiment 5 of the present invention.

As shown in FIG. 15, the liquid crystal display device of the present embodiment is provided with a bias power supply circuit 31. The bias power supply circuit 31 applies a bias voltage to a buffer amplifier which is provided to the data signal line driving circuit 2 adopting the line sequential driving method.

Figure 16:
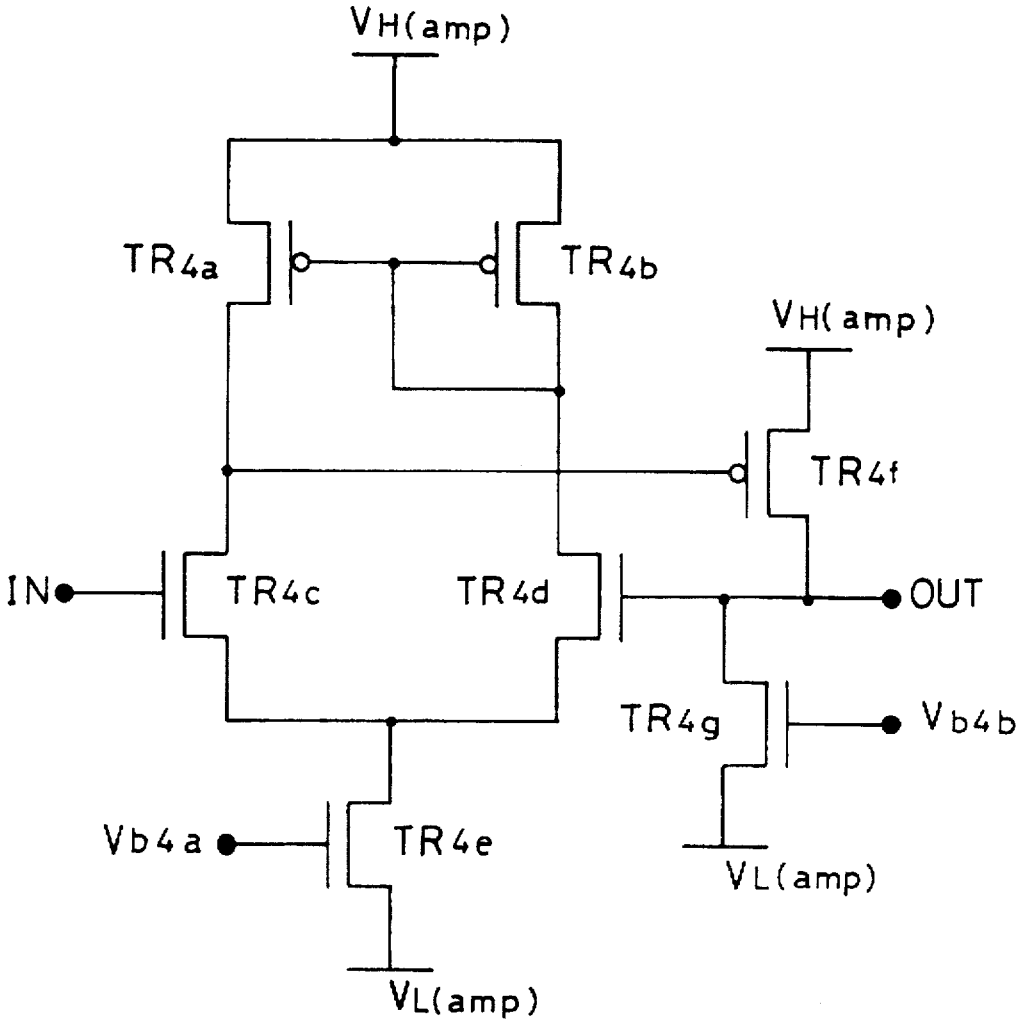
FIG. 16 is a circuit diagram which shows an arrangement of a buffer amplifier provided to a data signal line driving circuit in the liquid crystal display device of FIG. 15.
Figure 17:
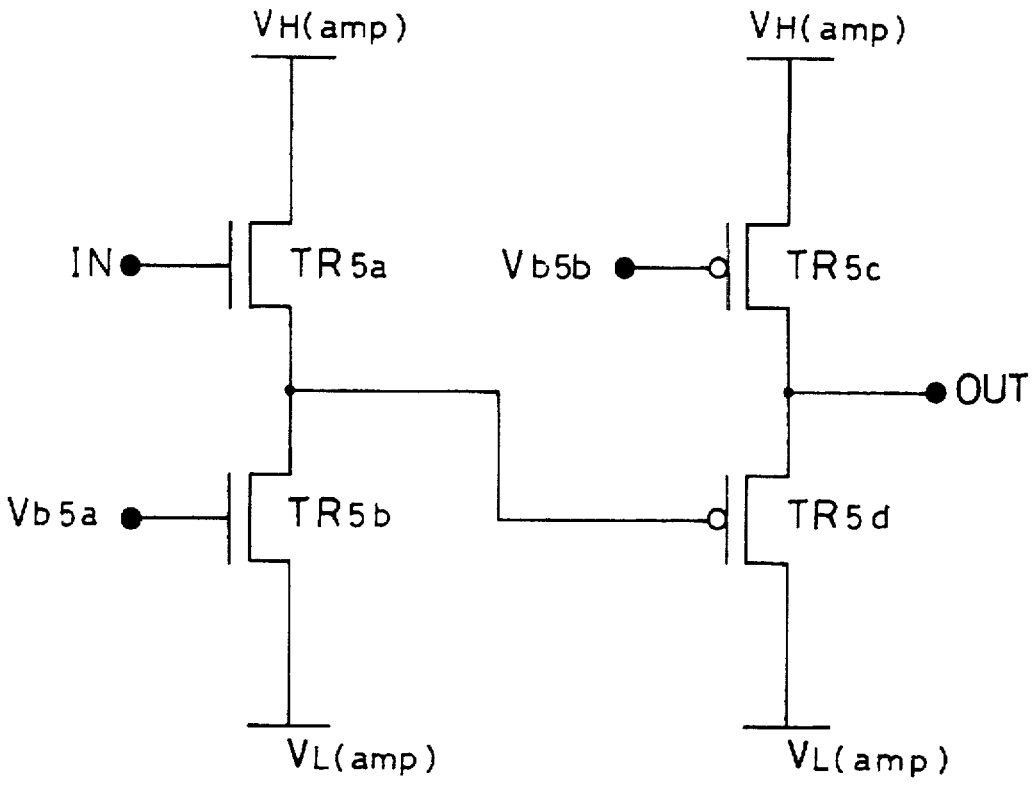
FIG. 17 is a circuit diagram which shows another arrangement of the buffer amplifier provided to the data signal line driving circuit in the liquid crystal display device of FIG. 15.

Examples of a buffer amplifier are shown in FIGS. 16 and 17. FIG. 16 shows a buffer amplifier composed of operational amplifiers composed of the transistors $TR_{4a}$ through $TR_{4g}$. Meanwhile, FIG. 17 shows a buffer amplifier composed of source follower amplifiers composed of transistors $TR_{5a}$ through $TR_{5d}$. These buffer amplifiers are operated by voltages $V_{H(amp)}$ and $V_{L(amp)}$.

The bias power supply circuit 31 has a reference voltage generating circuit 32 and a current supplying circuit 33. In the bias power supply circuit 31, its arrangement is basically same as that of the power supply circuits 21*a* and 21*b* shown in FIGS. 10 and 11, but only the values of reference voltages $V_{EE}$ and $V_{DD}$, and values of the resistances $R_{L\ and\ RH}$ are different.

More specifically, reference voltages $V_{BP}'$ and $V_{BN}'$ of the reference voltage generating circuit 32*a* shown in FIG. 10 respectively become $V_{L(amp)}+V_{on(amp)}+V_{th(n)}$ and $V_{H(amp)}-V_{on(amp)}+V_{th(p)}$. Therefore, bias voltages $V_{BN}$ and $V_{BP}$ whose levels are same as that of the reference voltages $V_{BP}'$ and $V_{BN}'$ are outputted from the current supplying circuit 33*a*. Then, the bias voltage $V_{BN}$ ($V_{b4a}$, $V_{b4b}$ and $V_{b5a}$) is applied to the gate electrodes of the transistors $TR_{4e}$, $TR_{4g}$ and $TR_{5b}$ for bias in the above buffer amplifiers, and the bias voltage $V_{BP}(V_{b5b})$ is applied to the gate electrode of the transistor $TR_{5c}$ for bias.

Meanwhile, the reference voltage generating circuit 32*b* shown in FIG. 11 generates the reference voltage $V_{BP}'$, which is higher than a certain constant voltage $V_{EE}$ only by the threshold voltage $V_{th(n)}$, and generates the reference voltage $V_{BN}'$, which is lower than a certain constant voltage $V_{DD}$ only by the threshold voltage $V_{th(p)}$. Moreover, the shift circuits 24*a* and 24*b* shift the reference voltages $V_{BP}'$ and $V_{BN}'$ to necessary voltages so that the current supplying circuit 33*b* outputs the bias voltages $V_{BP}$ and $V_{BN}$.

When resistance value $R_h$ ($R_1$) of the resistance $R_H$ ($R_L$) composing the shift circuits 24*a* and 24*b* in the present embodiment is selected so that the following relationships are fulfilled:

$$I_b \times R_h = V_{H(amp)} - V_{on(amp)} - V_{DD}$$

$$I_b \times R_1 = V_{L(amp)} + V_{on(amp)} - V_{EE},$$

the voltages are shifted by $-I_b \times R_h$ and $+I_b \times R_1$ so that desired bias voltages $V_{BP}$ and $V_{BN}$ represented by Equ. (3) can be obtained.

Regardless of the arrangement of the bias power supply circuit 31, the picture element array 1, the scan signal line driving circuit 2, the data signal line driving circuit 3 and the reference voltage generating circuit 32 are formed on one substrate 5. The circuits formed on the substrate 5 are composed of a monocrystal, polycrystal or amorphous silicon thin film transistor. Meanwhile, the current supplying circuit 33 is provided outside the substrate 5, and it is composed of an usual IC (integrated circuit), etc. formed on a monocrystal silicon substrate.

As mentioned above, in the present embodiment, the reference voltage generating circuit 32 is composed of a polycrystal silicon thin film transistor, etc. having the same configuration as that of the buffer amplifier, and it is formed on the common substrate 5. As a result, bias voltages which correspond with the threshold voltages of the transistors $TR_{4a}$ through $Tr_{4g}$ and the transistors $TR_{5a}$ through $TR_{5d}$ can be applied to the buffer amplifier. This can eliminate the influence of the variations in the threshold voltages between the transistors due to different substrates, and thus the supply voltages do not require adjustment. Moreover, since the current supplying circuit 33 is composed of an IC, it is possible to provide the bias power supply circuit 31 whose ability to supply a current is high and whose output is stable.

In the present embodiment, in the same manner as the embodiment 3, the configuration of the transistors $TR_{(n)}$ and $TR_{(p)}$ in the reference voltage generating circuit 32 are not necessarily limited.

Figure 18:
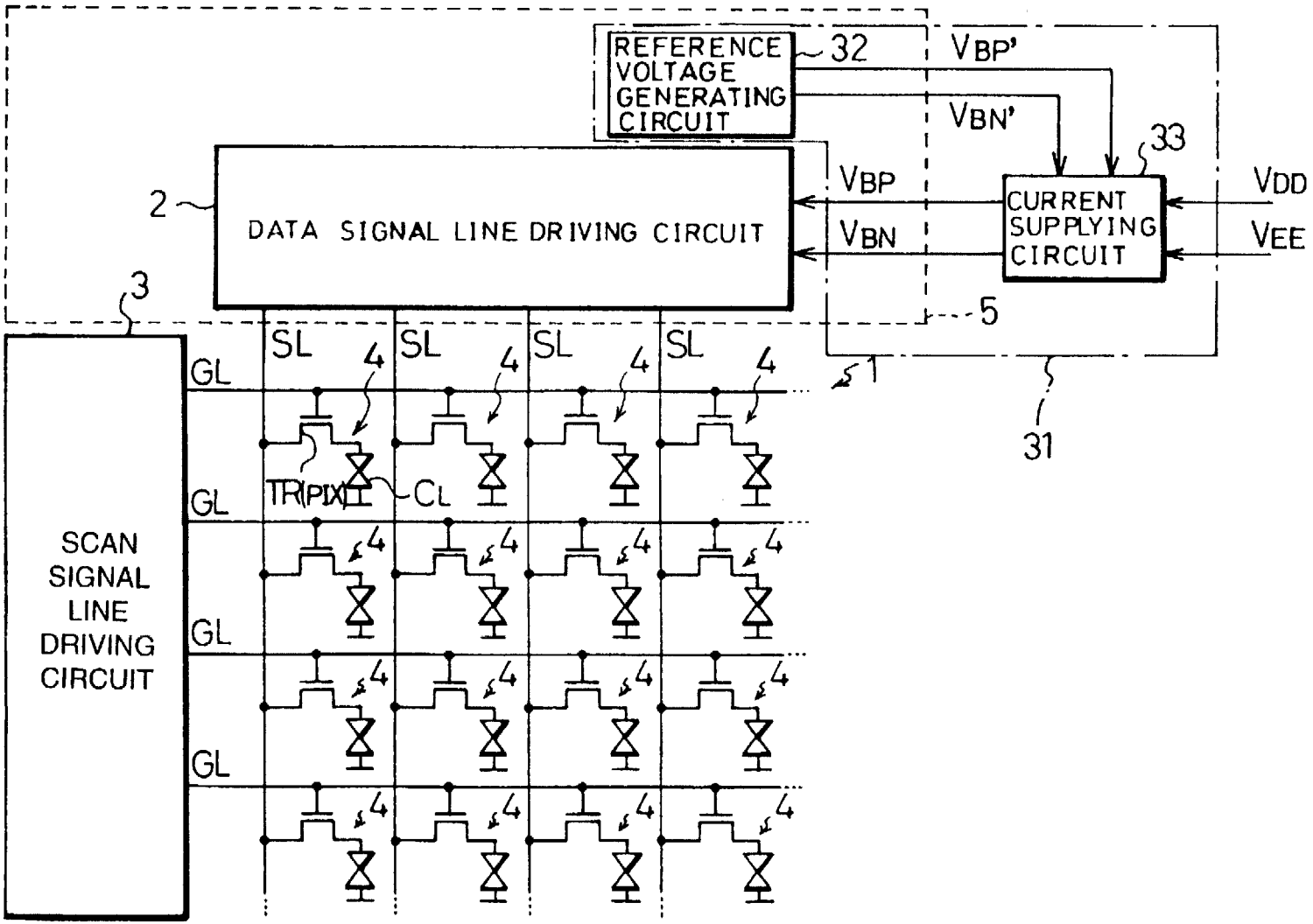
FIG. 18 is a block diagram which shows an arrangement of a main part of a liquid crystal display device according to a modified example of embodiment 5 of the present invention.

As shown in FIG. 18, the modified example of the present embodiment is different from the arrangement shown in FIG. 15 in that the scan signal line driving circuit 3 and the picture element array 1 are not formed on the substrate 5.

In the present modified example, since the reference voltage generating circuit 32 contains picture elements with the same configuration as the transistors composing the buffer amplifier in the data signal line driving circuit 2, it generates the reference voltages $V_{BP}'$ and $V_{BN}'$ according to the threshold voltage so as to be capable of outputting them to the current supplying circuit 33.

[EMBODIMENT 6]

Figure 19:
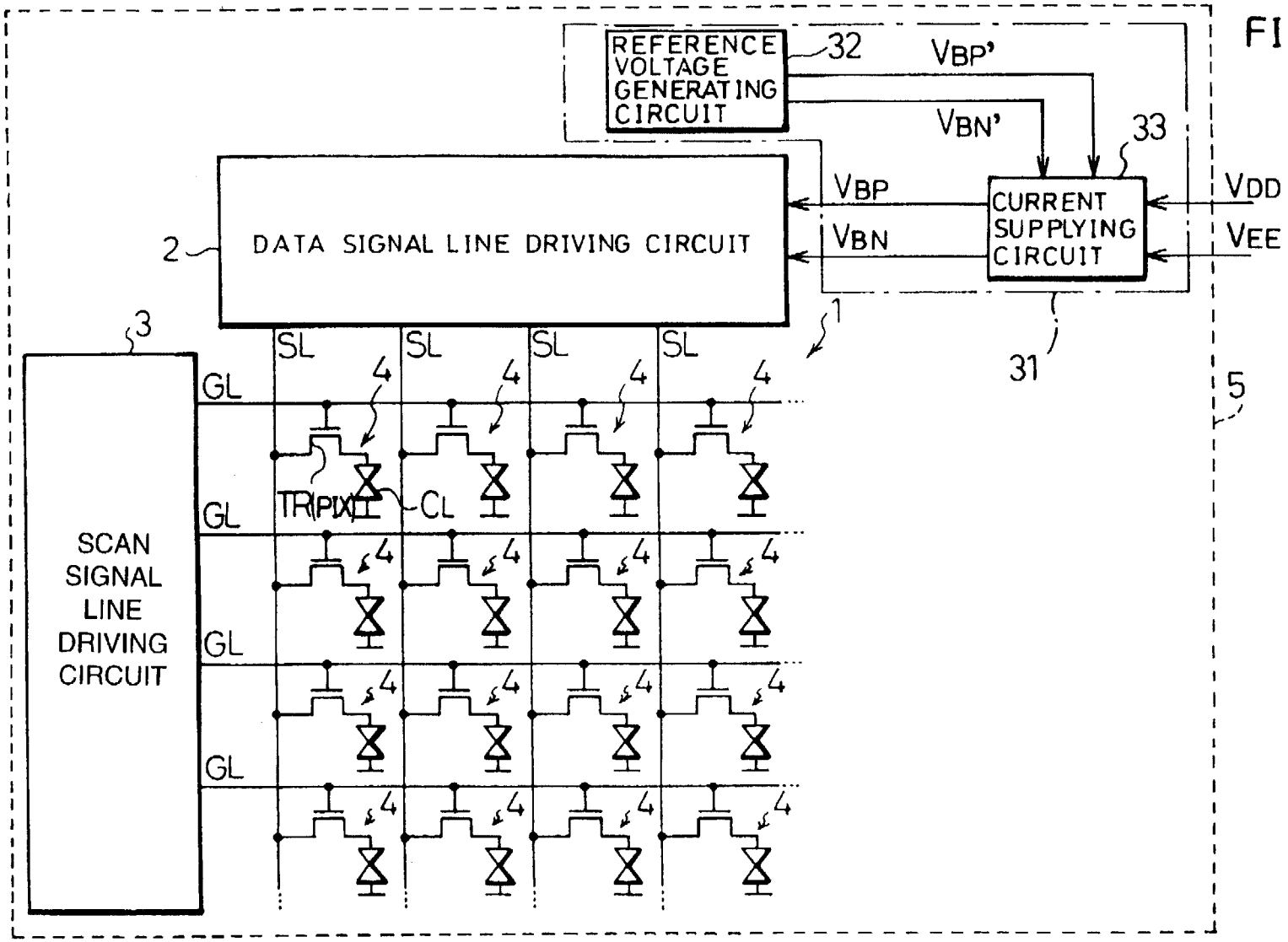
FIG. 19 is a block diagram which shows an arrangement of a main part of a liquid crystal display device according to embodiment 6 of the present invention.
Figure 20:
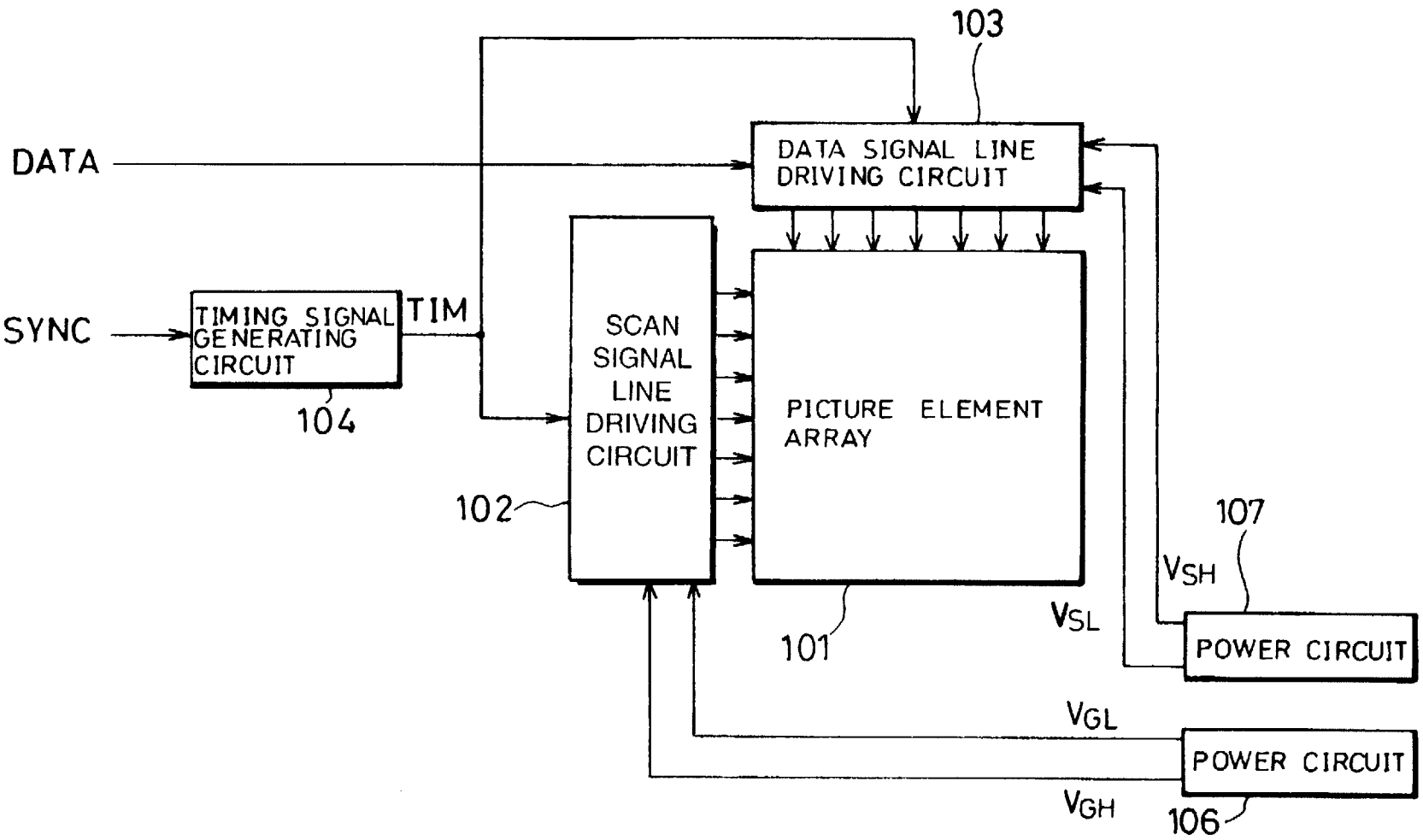
FIG. 20 is a block diagram which shows a schematic arrangement of a conventional liquid crystal display device.
Figure 21:
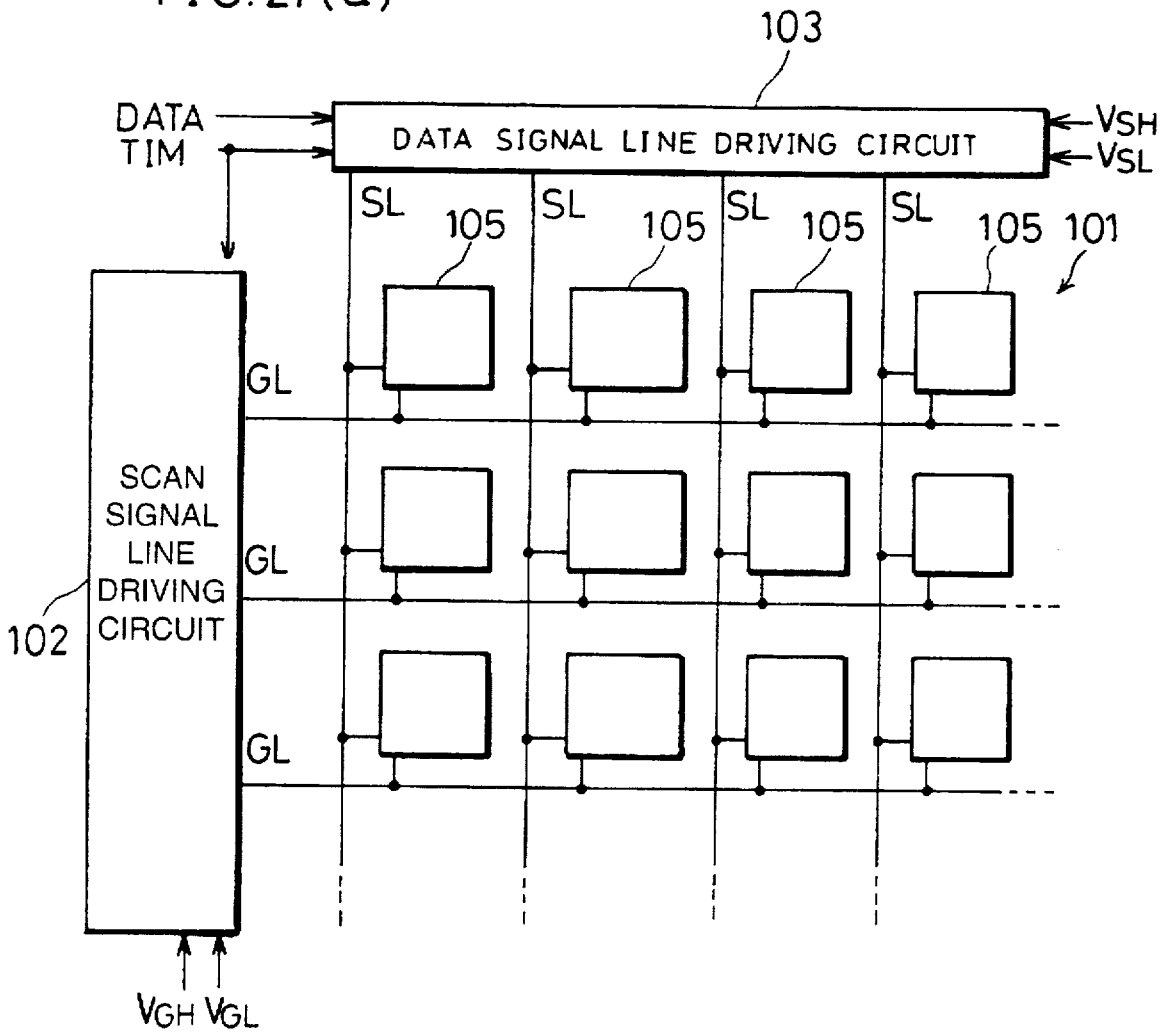
FIG. 21(*a*) is a block diagram which shows an arrangement of a picture element array in the liquid crystal display device of FIG. 20 and FIG. 21(*b*) is a circuit diagram which shows an arrangement of picture elements in the liquid crystal display device of FIG. 20.
Figure 21:
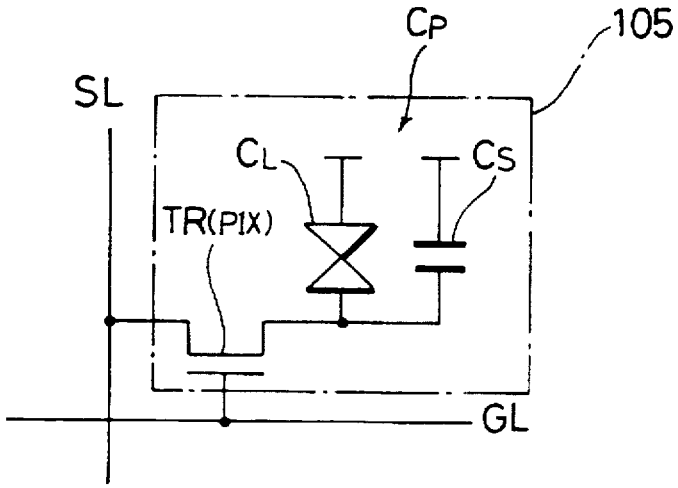
Figure 22:
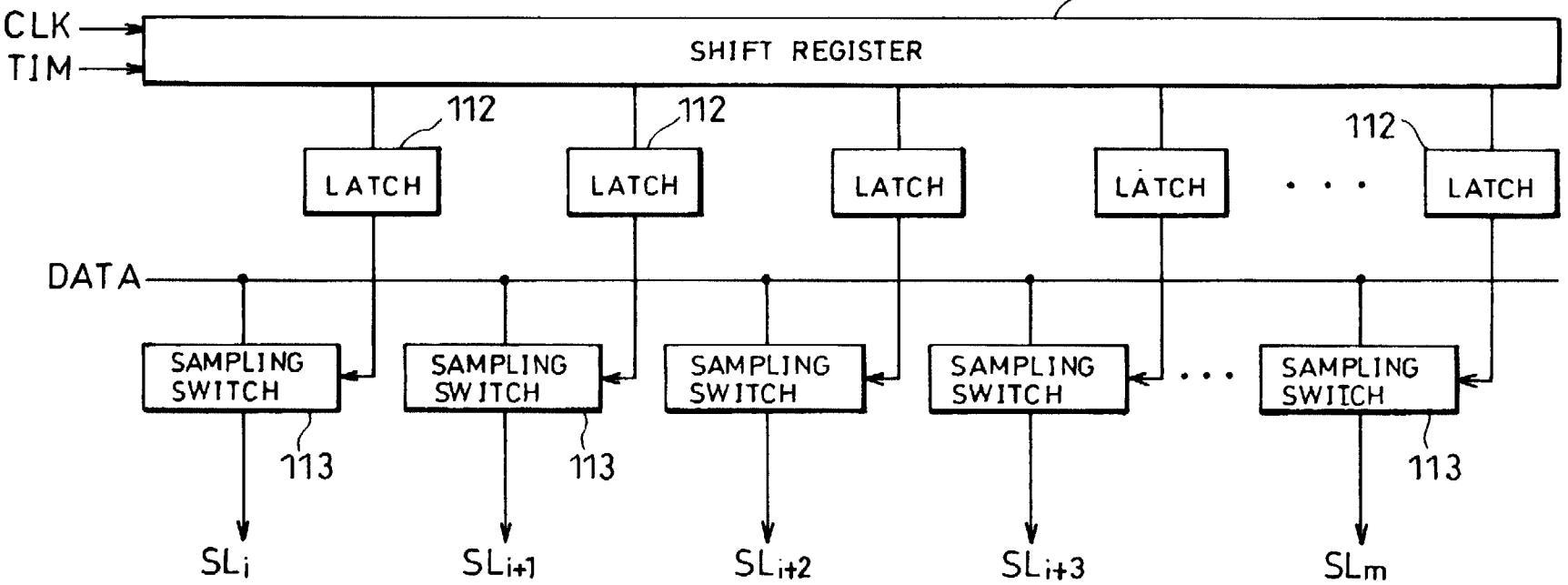
FIG. 22 is a block diagram which shows an arrangement of the data signal line driving circuit adopting a point sequential driving method in the liquid crystal display device of FIG. 20.
Figure 23:
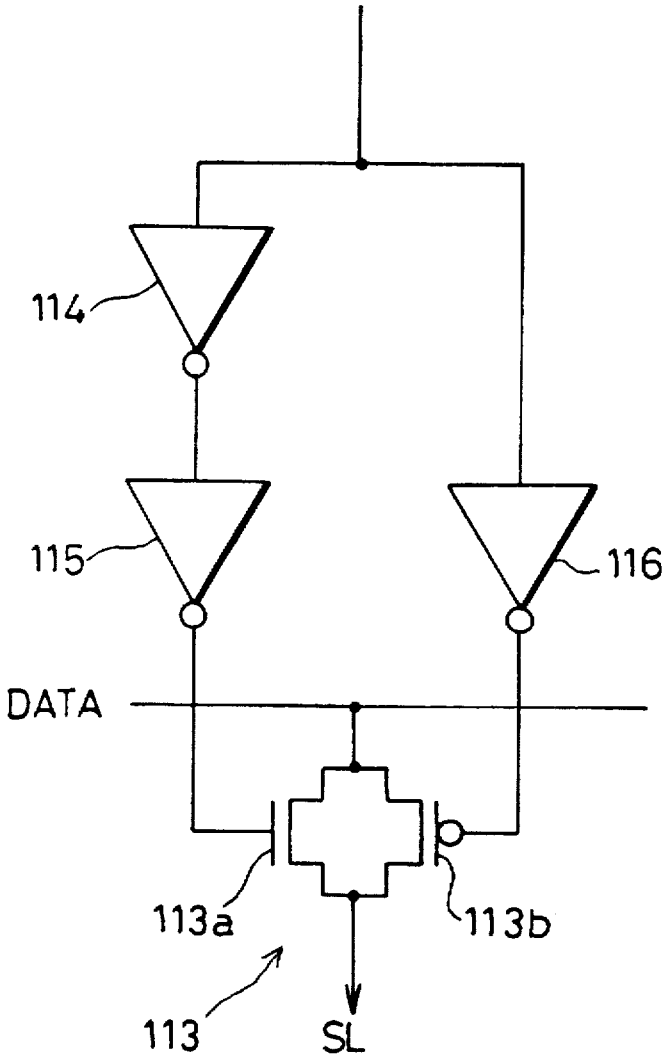
FIG. 23 is a circuit diagram which shows arrangements of a sampling switch and its peripheral circuit in the data signal line driving circuit of FIG. 22.
Figure 24:
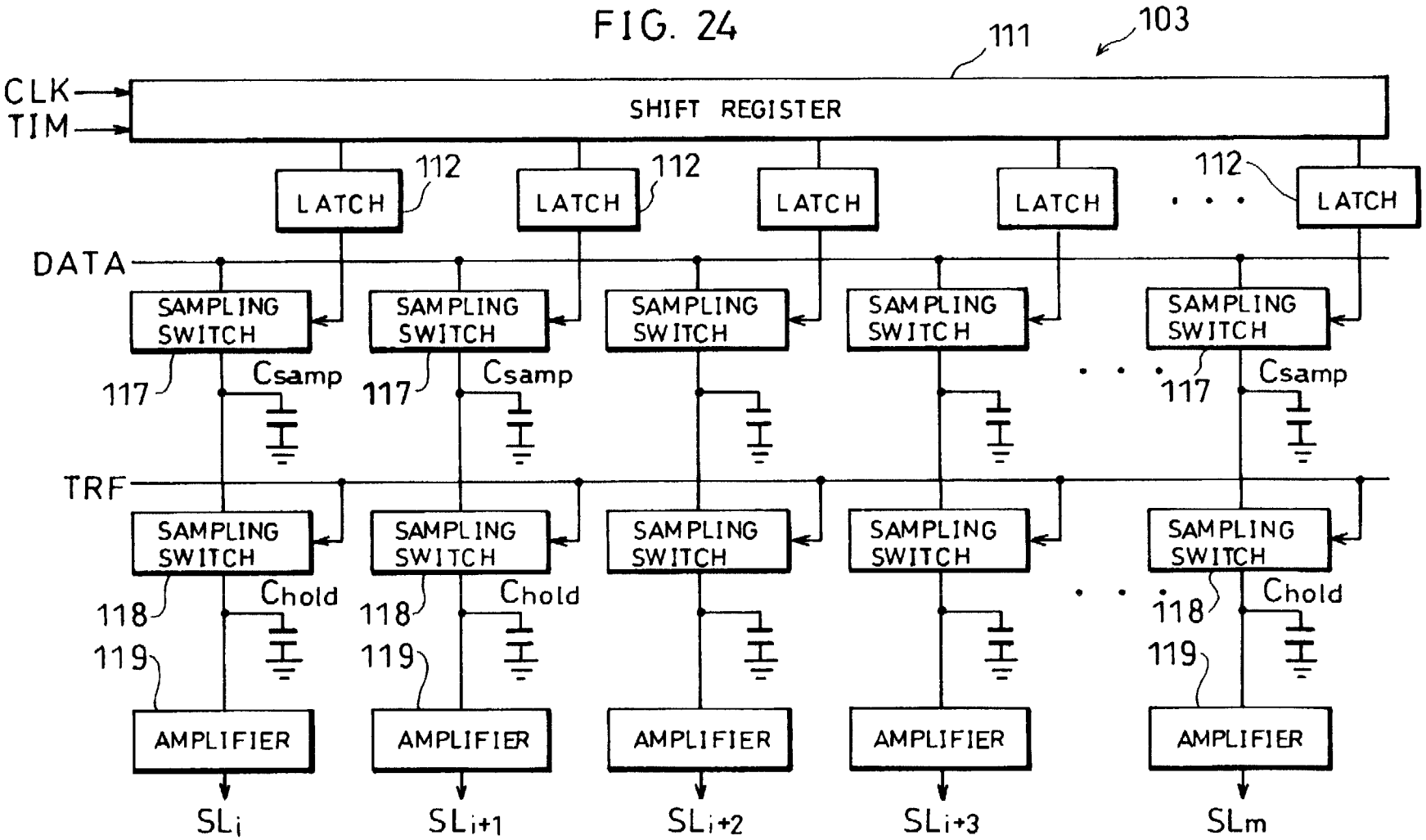
FIG. 24 is a block diagram which shows an arrangement of the data signal line driving circuit adopting a line sequential driving method in the liquid crystal display device of FIG. 20.
Figure 25:
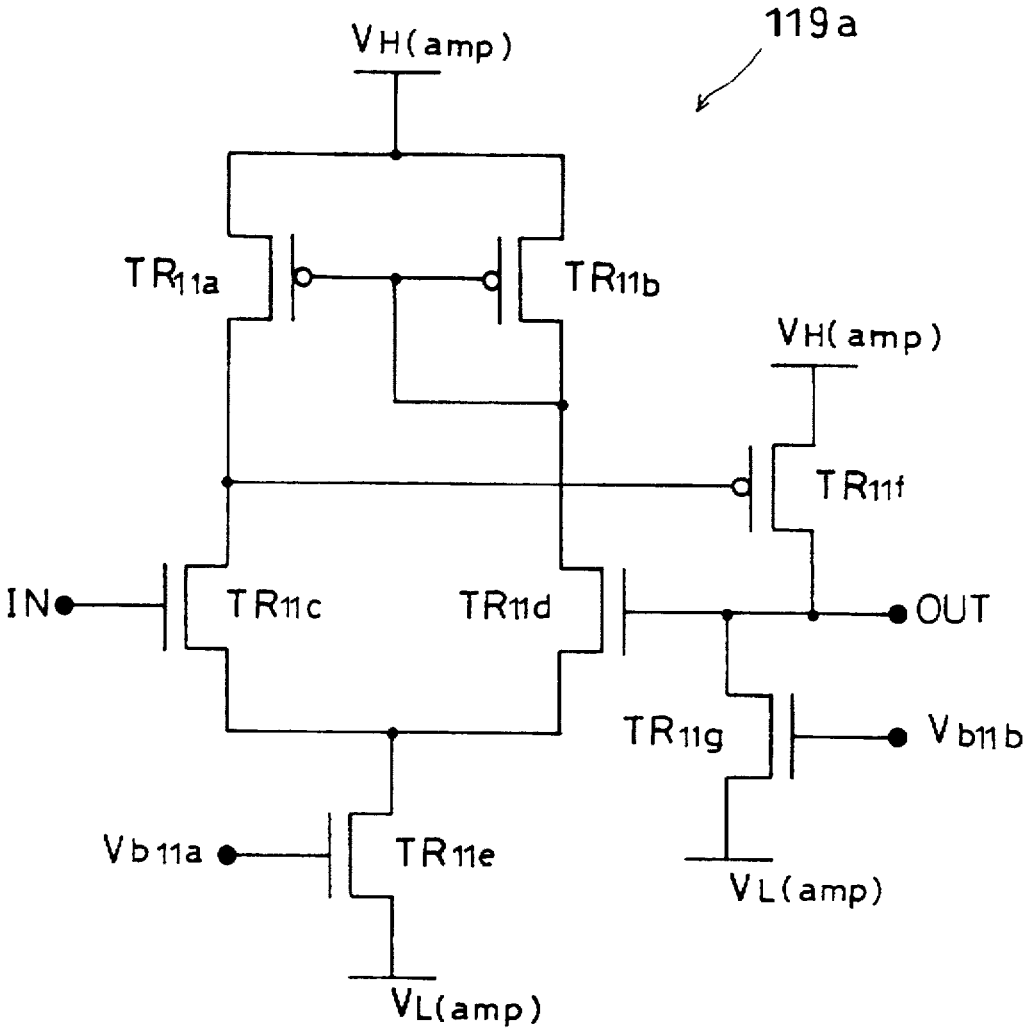
FIG. 25 is a circuit diagram which shows an arrangement of a buffer amplifier provided to the data signal line driving circuit in the liquid crystal display device of FIG. 20.
Figure 26:
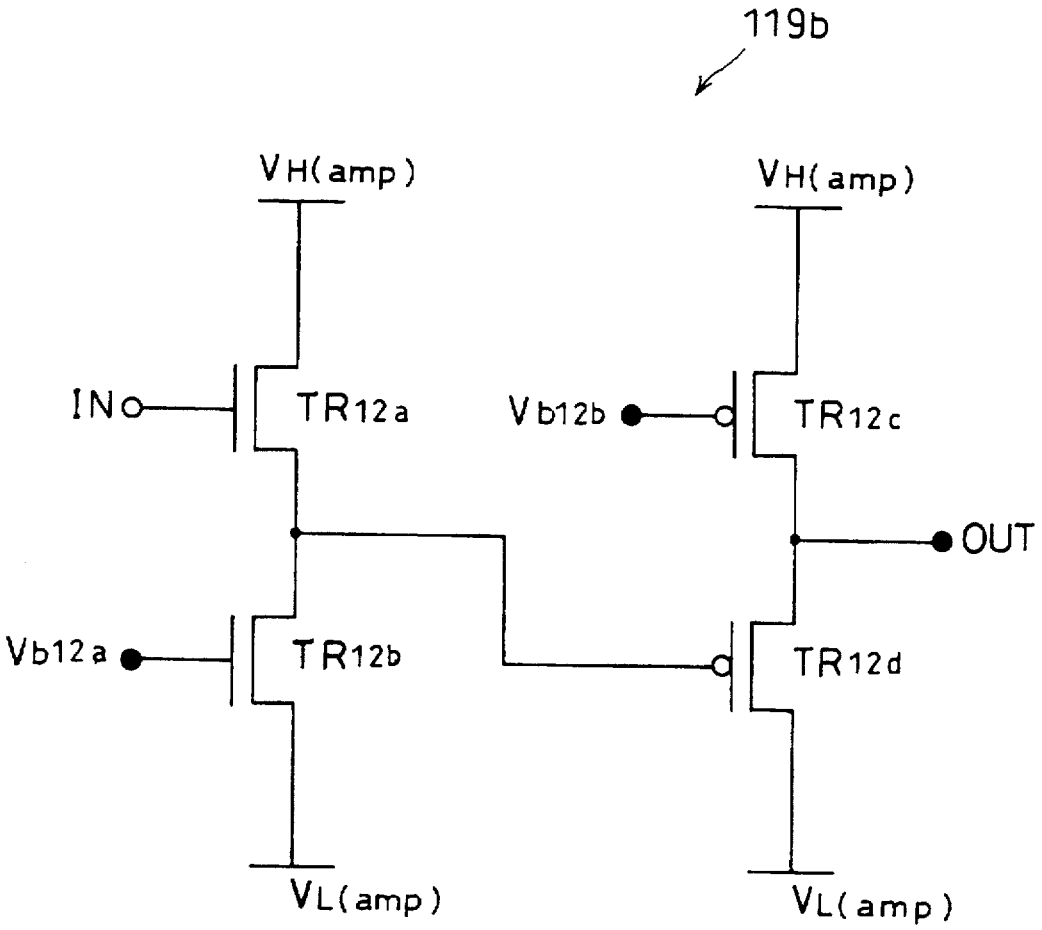
FIG. 26 is a circuit diagram which shows another arrangement of a buffer amplifier provided to the data signal line driving circuit in the liquid crystal display device of FIG. 20.

The following describes the sixth embodiment of the present invention in reference to FIG. 19. Here, for convenience of explanation, those members that have the same arrangement and functions, and that are described in the aforementioned embodiment 5 are indicated by the same reference numerals and the description thereof is omitted.

As shown in FIG. 19, in the liquid crystal display device of the present embodiment, the current supplying circuit 33 of the bias power supply circuit 31 as well as the picture element array 1, the data signal line driving circuit 2, the scan signal line driving circuit 3 and the reference voltage generating circuit 32 is formed on one substrate 5. The circuits formed on the substrate 5 are composed of a polycrystal silicon thin film transistor.

In the present embodiment, not only the reference voltage generating circuit 32 but also the current supplying circuit 33 are composed of a polycrystal silicon thin film transistor with the same configuration as the buffer amplifier, so bias voltages, which correspond with the threshold voltages of the transistors composing the buffer amplifier, can be applied to the buffer amplifier. Moreover, since the current supplying circuit 33 as well as the reference voltage generating circuit 32 is formed on the substrate 5, it is not necessary to provide signal lines and power lines outside the substrate 5 between the reference voltage generating circuit 32 and the current supplying circuit 33, thereby making it possible to provide an image display panel having fewer external terminals.

In the present embodiment, in the same manner as the embodiment 5, the arrangements of the transistors in the reference voltage generating circuit 32 are not necessarily limited, and the circuits formed on the substrate 5 are not necessarily limited to the polycrystal silicon thin film transistor. For example, a monocrystal silicon thin film transistor or an amorphous silicon thin film transistor is applicable to the circuits.

As mentioned above, the image display device of embodiments 1 through 6 has a first transistor provided to picture elements or a signal supplying circuit which supplies a signal to the picture elements, a second transistor, which is formed on a substrate where the first transistor is formed, a power supply circuit which has a reference voltage generating circuit for generating a reference voltage based upon the threshold voltage of the second transistor, and a current supplying circuit for supplying a current to the signal supplying circuit based upon the output of the reference voltage generating circuit.

In accordance with the above arrangement, the power supply circuit applies a voltage, which is optimized for the characteristic of the first transistor, to the signal supplying circuit based upon the threshold voltage of the second transistor having the approximately same characteristic as the first transistor. Moreover, the voltage applied by the power supply circuit follows a change in the threshold voltage of the first transistor due to the usage environment.

Therefore, even if the threshold voltage of the first transistor is different between each substrate, or if the threshold voltage is changed due to the usage environment, the voltages applied by the power supply circuit do not require adjustment. As a result, the cost of adjustment is reduced and convenience of the usage is improved. Moreover, since the most suitable voltage to be applied to the signal supplying circuit is always maintained, the image display device can display an image with high quality. Therefore, the image display device with excellent ability can be provided at lower price.

Various kinds of combinations of the signal supplying circuit and the first transistor are considered.

In an example of the combinations, as described in embodiments 1 and 2, the first transistor may be a picture element transistor, and the signal supplying circuit may be a circuit, such as the scan signal line driving circuit which supplies a control signal to the picture element transistor. In this case, the second transistor as well as the picture element transistor is formed on one substrate, and the second transistor and the picture element transistor have the approximately equal threshold voltage. As a result, the power supply circuit applies a driving voltage, which is optimized for the characteristic of the picture element transistor, to the signal supplying circuit.

Therefore, the driving voltage of the signal supplying circuit does not require adjustment per each substrate (picture element array) or every time when the usage environment is changed. As a result, the cost of adjustment is reduced and convenience of the usage is improved. Moreover, since the most suitable driving voltage can be always maintained, the image display device can display an image with high quality.

In addition, as mentioned in embodiments 3 and 4, the signal supplying circuit may be a circuit, such as the data signal line driving circuit which includes the first transistor and supplies a video signal to the picture elements. In this case, the second transistor as well as the signal supplying circuit is formed on one substrate, and the first and second transistors have the approximately equal threshold voltage. As a result, the driving voltage of the signal supplying circuit automatically obtains a value which is optimized for the characteristic of the first transistor composing the signal supplying circuit.

Therefore, the supply voltage does not require adjustment per each substrate (picture element array) or every time when the usage environment is changed. As a result, the cost of adjustment is reduced and convenience of the usage is improved. Moreover, since the most suitable power supply voltage is always maintained, the image display device can display an image with high quality.

In addition, as mentioned in embodiments 5 and 6, the signal supplying circuit may be a buffer amplifier including the first transistor. The buffer amplifier is provided, for example, to the output stage of the data signal line supplying circuit. In this case, the second transistor as well as the buffer amplifier is formed on one substrate, and the first and second transistors of the buffer amplifier have the approximately equal threshold voltage. As a result, the bias voltage, which is applied to the buffer amplifier by the power supply circuit, automatically obtains a value which is optimized for the characteristic of the first transistor.

Therefore, the supply voltage does not require adjustment per each substrate (picture element array) or every time when the usage environment is changed. As a result, the cost of adjustment is reduced and convenience of the usage is improved. Moreover, since the most suitable voltage is always maintained, the image display device can display an image with high quality.

In any arrangements, since the power supply circuit applies an automatically optimized voltage to the signal supplying circuit, the image display device with high ability can be provided at lower price.

In addition, as mentioned in embodiments 1 through 6, it is preferable that the first and second transistors are formed so as to have the approximately same element configuration. As a result, the characteristics of the first and second transistors can be easily and accurately arranged.

In addition, it is preferable that the first and second transistors are made of a thin film transistor, such as a monocrystal silicon thin film, a polycrystal silicon thin film or an amorphous silicon thin film. A thin film transistor is inferior to a transistor formed on a monocrystal silicon substrate in controllability (variations). Therefore, in the conventional arrangement, adjustment of supply voltages, such as a driving voltage and a bias voltage, becomes more important, so the usage of the thin film transistor is limited due to the cost of adjustment and the convenience of usage. However, in accordance with the arrangements of embodiments 1 through 6, since the supply voltages do not require adjustment, the thin film transistor can be put efficiently to practical use, thereby making it possible to realize a large-sized image display device whose packaging is easy.

In addition, it is preferable that the first and second transistors are formed by a polycrystal silicon thin film formed at temperature of 300° C. to 600° C. As a result, a glass substrate can be used as the thin film substrate. Therefore, it is possible to realize a larger image display device whose packaging is easier.

In addition, the current supplying circuit may be formed on the substrate where the first and second transistors were formed, or may be formed on different substrates.

As mentioned in embodiments 1, 3 and 5, for example, in the case where they are formed on the same substrate, wirings between them (signal lines and power lines) are formed inside the substrate. Therefore, the packaging of the image display device is simplified.

Meanwhile, as mentioned in embodiments 2, 4 and 6, in the case where they are formed on different substrates, an usual integrated circuit (IC) formed on a monocrystal silicon substrate can be used as the current supplying circuit. As a result, the ability to supply a current in the current supplying circuit becomes large, and thus the stable power supply circuit is arranged.

In addition, the picture element may be provided with liquid crystal elements. In a liquid crystal display device, as a number of gradations of display increases, requirements of the writing and retaining of a video signal become more strict, and thus the supply voltage should be adjusted more exactly. However, in accordance with the above arrangement, since the supply voltages do not require adjustment, the liquid crystal display device can easily meet these requirements. As a result, a liquid crystal display device whose convenience of usage is excellent can be obtained at low price.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image display device, comprising:

a plurality of picture elements for display which are arranged in a matrix pattern;

a signal supplying circuit for supplying a signal to said picture elements;

a first transistor for changing a display state of said picture elements according to a change in its threshold voltage, said first transistor being provided to said picture elements or said signal supplying circuit;

a second transistor which is formed on a substrate where said first transistor is formed and has the approximately same threshold voltage as said first transistor; and a power supply circuit having a reference voltage generating circuit for generating a reference voltage based upon the threshold voltage of said second transistor and a current supplying circuit for supplying a current to said signal supplying circuit based upon the output of said reference voltage generating circuit.

2. The image display device as defined in claim 1, wherein:

said first transistor is a picture element transistor which controls the display state on each picture element, said signal supplying circuit supplies a control signal which controls writing of a video signal to said each picture element transistor.

3. The image display device as defined in claim 1, wherein:

said signal supplying circuit includes said first transistor and supplies a video signal to said each picture element, said current supplying circuit supplies a driving voltage to said signal supplying circuit.

4. The image display device as defined in claim 1, wherein:

said signal supplying circuit including said first transistor is a buffer amplifier for outputting a video signal of the same level as a video signal to be inputted to each picture element, said current supplying circuit applies a bias voltage, which adjusts the output level of the video signal, to the buffer amplifier.

5. The image display device as defined in claim 1, wherein said second transistor is formed so as to have the element construction which is approximately same as said first transistor.

6. The image display device as defined in claim 1, wherein said first and second transistors are made of a polycrystal silicon thin film.

7. The image display device as defined in claim 6, wherein said first and second transistors are made of the polycrystal silicon thin film formed at temperature of 300° C. to 600° C.

8. The image display device as defined in claim 1, wherein said first and second transistors are made of a monocrystal silicon thin film.

9. The image display device as defined in claim 1, wherein said first and second transistors are made of an amorphous silicon thin film.

10. The image display device as defined in claim 1, wherein said first transistor, said current supplying circuit and said reference voltage generating circuit are formed on one substrate.

11. The image display device as defined in claim 1, wherein said current supplying circuit and said first transistor are formed on different substrates.

12. The image display device as defined in claim 1, wherein said picture elements include liquid crystal.

13. The image display device as defined in claim 11, wherein said current supplying circuit is formed on a monocrystal silicon substrate.

* * * * *